US006245498B1

(12) United States Patent
Suzuki et al.

(10) Patent No.: US 6,245,498 B1
(45) Date of Patent: Jun. 12, 2001

(54) SILVER HALIDE EMULSION

(75) Inventors: Katsuhiko Suzuki, Hino; Hiromoto Ii; Sadayasu Ishikawa, both of Hachioji, all of (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/391,127

(22) Filed: Sep. 7, 1999

Related U.S. Application Data

(63) Continuation-in-part of application No. 09/169,646, filed on Oct. 9, 1998.

(30) Foreign Application Priority Data

Oct. 15, 1997 (JP) ..... 9-297788

(51) Int. Cl.[7] ..... G03C 1/035; G03C 1/09

(52) U.S. Cl. ..... 430/567; 430/599; 430/604; 430/605

(58) Field of Search ..... 430/567, 599, 430/604, 605

(56) References Cited

U.S. PATENT DOCUMENTS

| | | | | |
|---|---|---|---|---|
| 5,358,842 | * | 10/1994 | Kasai et al. | 430/569 |
| 5,362,618 | * | 11/1994 | Ishikawa et al. | 430/567 |
| 5,498,516 | | 3/1996 | Kikuchi et al. | 430/567 |
| 5,807,663 | * | 9/1998 | Funakubo et al. | 430/567 |

FOREIGN PATENT DOCUMENTS 2 516 264 5/1983 (FR) .

* cited by examiner

*Primary Examiner*—Hoa Van Le
(74) *Attorney, Agent, or Firm*—Frishauf, Holtz, Goodman, Langer & Chick, P.C.

(57) ABSTRACT

A silver halide emulsion is disclosed, comprising tabular grains having an aspect ratio of 5 or more, the tabular grains further having dislocation lines of 30 or more per a grain, in a fringe portion of the grain and the tabular grains each containing silver iodide, the content of which gradually and continuously varies in the direction of from the grain center to the edge.

8 Claims, 3 Drawing Sheets

SILVER HALIDE EMULSION

This is a Contimuation-In-Part application of Ser. No. 09/169,646 filed Oct. 9, 1998 which is hereby incorporated in its entirety by this reference

FIELD OF THE INVENTION

The present invention relates to a silver halide emulsion improved in sensitivity, pressure resistance and processability.

BACKGROUND OF THE INVENTION

Recently, demand for enhanced sensitivity and image quality of silver halide light sensitive photographic materials has become stronger. In addition, requirements for enhanced photographic performance which is more resistant under external factors such as pressure, processing fluctuations and storage at high temperature and/or high humidity, have been increased.

In response to such requirements, an attempt to enhance photographic performance of a silver halide emulsion by introducing dislocation lines into silver halide grains was made. JP-A 63-220238 and 1-102547 (herein, the term, JP-A means an unexamined published Japanese Patent Application) disclose techniques for improving photographic characteristics through the introduction of dislocation lines. However, as can be seen from the fact that the disclosure of the techniques described above was followed by disclosure of a number of techniques regarding the dislocation lines, further improved technique of dislocation line introduction is still required.

JP-A 3-175440 discloses a technique of allowing dislocation lines to be concentrated at the edge of tabular grains to improve sensitivity and reciprocity law failure characteristics. JP-A 6-27564 discloses a technique of restricting dislocation lines to fringe portions of tabular grains to improve sensitivity and pressure resistance.

Noticeable results of the prior art include improvements of photographic performance by restricting the position of dislocation lines to a specific site. It is supposed by the inventors of the present invention that restriction of dislocation lines to the specific position also limits the position of deteriorating factors produced along with the dislocation lines and these techniques are restrained so as to not produce influences counteracting improvement effects due to the dislocation lines.

The inventors further noted that introduction of iodide ions accompanied formation of a high iodide layer within the grain. As disclosed in JP-A 6-27564, a means for introducing dislocation lines is to introduce iodide ions, forming a gap or misfit of the crystal lattice.

In a technique regarding an iodide content continuously varying layer disclosed in JP-A 5-53232, 9-138473 and 9-211759, improvement of photographic performance such as sensitivity and pressure resistance were accomplished by reducing the gap and/or misfit of the crystal lattice. However, the gap and/or misfit of the crystal lattice resulting from introducing the dislocation in the prior art, i.e. the presence of a layer in which the iodide content is steeply varied, resulted in possibility of counteracting the effects of the iodide content continuously varying layer described above.

It has not been clarified from the prior study whether the crystal lattice gap/misfit as in the prior art is essentially dispensable or not to introduce the dislocation lines. It is supposed that an excessively high iodide layer may be formed.

The presence of the high iodide containing layer with the grain is contemplated to be related to deterioration of photographic performance, such as sensitivity loss due to closely localized lattice defects, lowered pressure resistance and deterioration in processability due to iodide ions released at development.

Supposing that when dislocation lines are formed according to the prior art, a high iodide layer is also concurrently formed, leading to deterioration in photographic performance due to the high iodide layer as well as improved photographic performance due to the dislocation lines, so that effects of the dislocation lines can not be sufficiently displayed, the inventors of the present invention made further study.

SUMMARY OF THE INVENTION

Accordingly, it is an object of the present invention to provide a silver halide emulsion with enhanced sensitivity and superior pressure resistance and improved processability.

The above object of the invention can be accomplished by the following constitution:

(1) a silver halide emulsion comprising a dispersing medium and silver halide grains, wherein at least 30% of total grain projected area is accounted for by tabular grains having an aspect ratio of 5 or more and further having dislocation lines of 30 or more per a grain, in a fringe portion of the grain, and the tabular grains each containing silver iodide, the content of which gradually and continuously varies in the direction of from a center to an edge of the grain;

(2) the silver halide emulsion described in (1), wherein tabular grains having a silver iodide border account for less than 20% of total grain projected area;

(3) the silver halide emulsion described in (1) or (2), wherein a variation coefficient of grain size distribution is 25% or less and a variation coefficient of grain thickness distribution being 35% or less;

(4) the silver halide emulsion described in any one of (1) to (3), wherein at least 50% of the projected area of total silver halide grains is accounted for by tabular grains having 30 or more dislocation lines per grain, which are localized only in the fringe portion;

(5) the silver halide emulsion described in any one of (1) to (4), wherein at least a part of the tabular grains each contain a reduction sensitization center in the interior of the grain;

(6) the silver halide emulsion described in any one of (1) to (5), wherein at least a part of the tabular grains each contain a polyvalent metal compound in the fringe portion of the grain; and (7) a silver halide emulsion comprising silver halide grains, wherein at least 50% of total grain projected area is accounted for by tabular grains having an aspect ratio of 5 or more, at least 50% of total grain projected area is accounted for by tabular grains having 30 or more dislocation lines per grain in the fringe portion, and at least 50% of total grain projected area is accounted for by tabular grains. in which the silver iodide content gradually and continuously varies from the grain center portion to the grain edge portion.

DETAILED DESCRIPTION OF THE INVENTION

Figure 1:
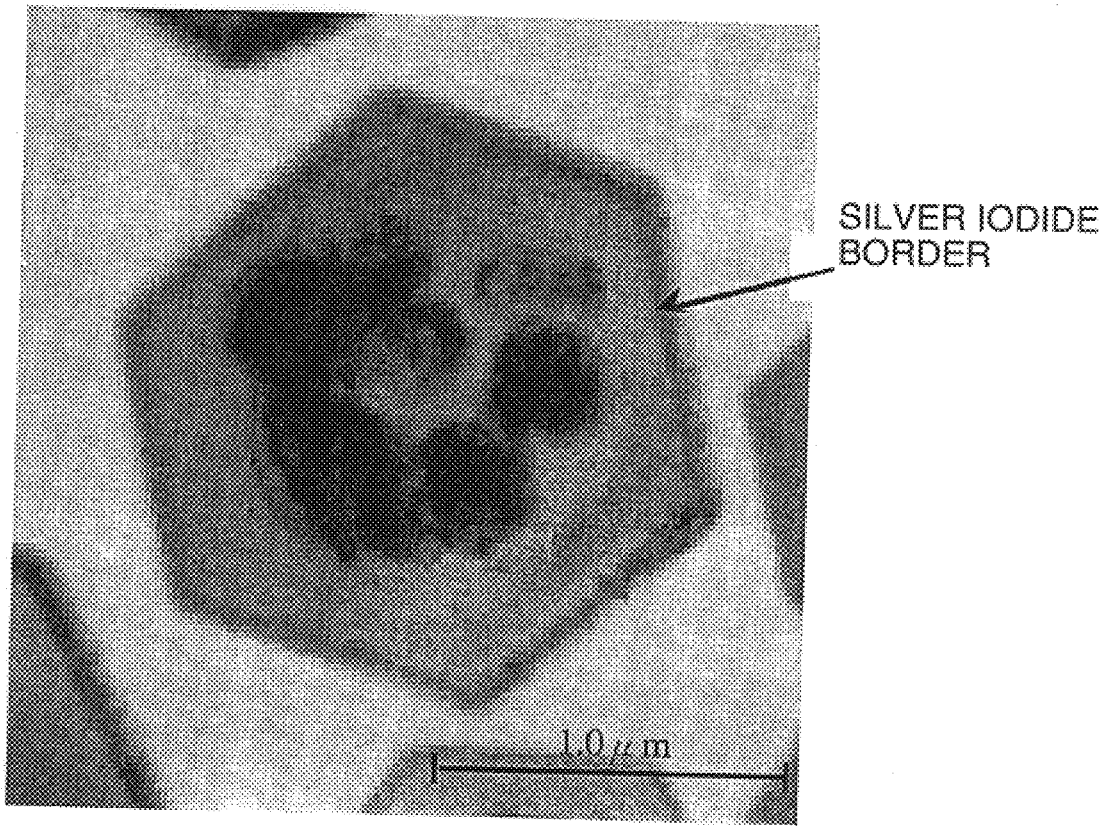
FIG. 1 is an electronmicrograph of a silver halide grain having a silver iodide border.

Effects of the present invention are supposed to be attributable mainly to reduction of a high iodide containing layer formed at the time of introducing dislocation lines without lowering the dislocation line introducing efficiency and also to its synergistic effect with grain monodispersity, shallow electron trapping centers and reduction sensitization.

Thus, the essential of the present invention is that the position of photographic performance deteriorating factors which are concurrently produced with the dislocation lines, is not limited, as in the prior art, but the photographic performance deteriorating factors themselves are reduced.

In the present invention, dislocation lines are closely introduced and abrupt variation in silver iodide content produced when introducing the dislocation lines is prevented. As a result, the silver iodide content is gradually and continuously varied overall the grain, resulting in close dislocation lines. On the contrary, in a technique disclosed in JP-A 9-211759, in which an iodide content continuously varying layer is formed within a grain, abrupt variation in the silver iodide content, which is produced along with introduction of the dislocation lines, can not be prevented.

The present invention will be further described in detail. A silver halide emulsion according to the invention comprises grains in a tabular form (hereinafter, denoted simply as tabular grains). The tabular grains are crystallographically classified as twinned crystals.

The twinned crystal is a silver halide crystal having one or more twin planes within the grain. Classification of the twinned crystal form is detailed in Klein & Moisar, Photographishe Korrespondenz, Vol.99, p.100, and ibid Vol.100, p.57.

The tabular grains according to the invention are preferably ones having two or more twin planes parallel to the major faces. The twin planes can be observed with a transmission electron microscope, for example, according to the following manner. A coating sample is prepared by coating a silver halide emulsion on a support so that the major faces of tabular silver halide grains are oriented substantially parallel to the support. The sample is cut using a diamond cutter to obtain an approximately. 0.1 $\mu$m thick slice. The twin plane can then be observed with a transmission electron microscope.

The spacing between twin planes can be determined according to the following manner. Thus, 1,000 tabular grains exhibiting a cross-section perpendicular to the major faces are selected through transmission electron microscopic observation of the slice and the shortest twin plane spacing of each grain is measured to obtain an arithmetic average thereof. The average twin plane spacing is preferably 0.01 to 0.05 $\mu$m, and more preferably 0.013 to 0.025 $\mu$m. The twin plane spacing can be controlled by selecting an optimal combination of parameters affecting supersaturation at nucleation, such as the gelatin concentration, the kind of gelatin, the temperature, the iodide ion concentration, pBr, pH, the ion supplying rate and the stirring rate. Details of the supersaturation parameter can be referred to, for example, in JP-A 63-92924 and 1-213637.

The thickness of the silver halide grains according to the invention can be determined in the following manner. The silver halide grains are subjected to metal deposition, along with latexes for reference from the direction oblique to the grains and electronmicrographs are taken. The shadow length is measured from the electronmicrograph, and the grain thickness can be determined by reference to the latex shadow length. The average grain thickness (d) is defined as di when the product of the frequency (ni) of grain with a thickness (di) and $di^3$ (i.e., $ni \times di^3$) is maximal (with the significant figure being three, and the last digit being rounded off). The number of measured grains is 600 or more at random. The average thickness of the silver halide grains according to the invention is preferably 0.05 to 1.5 $\mu$m, and more preferably 0.07 to 0.50 $\mu$m.

The grain size of the silver halide grains according to the invention is represented in terms of an equivalent circle diameter of the projected area of the silver halide grain (i.e., the diameter of a circle having an area equivalent to the projected area of the grain).

The tabular grains according to the invention are those having an aspect ratio (or a ratio of grain diameter to grain thickness) of 5 or more and accounting for at least 50% of the total grain projected area, and preferably are those having a 6 to 80 aspect ratio and accounting for at least 60% of the total grain projected area.

The grain diameter can be determined by viewing silver halide grains with an electron microscope and measuring the projected area. The average grain diameter (r) is defined as ri when the product of the frequency (ni) of grain with a diameter (ri) and $ri^3$ (i.e., $ni \times ri^3$) is maximal, in which at least 6000 randomly selected grains, are subjected to measurement. The average grain diameter is preferably 0.1 to 5.0 $\mu$m, and more preferably 0.2 to 2.5 $\mu$m.

The silver halide emulsion according to the invention is preferably a monodispersed emulsion. The monodispersed emulsion has preferably 25% or less, more preferably 20% or less, and still more preferably 16% or less of the grain diameter distribution width (or a variation coefficient of grain diameter), as defined below:

(standard deviation of grain diameter, ri/average grain diameter, r)×100=variation coefficient of grain diameter distribution [%].

The monodispersed emulsion according to the invention has preferably 25% or less of the grain diameter distribution width.

Similarly, the emulsion according to the invention has preferably 35% or less, more preferably 25% or less, and still more preferably 20% or less of the grain thickness distribution width (or a variation coefficient of grain diameter), as defined below:

(standard deviation of grain thickness, di/average grain diameter, d)×100=variation coefficient of grain thickness distribution [%].

The tabular grains according to the invention may be comprised of a core and a shell covering the core. The shell may be formed of one or more layers. In cases where the tabular grains are core/shell type grains as described above, the halide composition of the core and shell can optionally be selected. The silver iodide content of the core or shell is preferably 5 mol % or less, and more preferably 3 mol % or less. The core preferably accounts for 1 to 60%, based on the total silver amount, and more preferably 4 to 40%. The average overall iodide content of the tabular grains of the invention is preferably not more than 10 mol %, more preferably not more than 7 mol %, and still more preferably not more than 4 mol %.

The silver halide emulsion according to the invention preferably comprises mainly silver iodobromide, and may further comprise other halide, such as chloride.

Means for forming the tabular grains according to the invention include a variety of methods known in the art. Thus, single jet addition, controlled double jet addition and controlled triple jet addition can be employed individually or in combination. To obtain highly monodispersed grains, it is important to control the pAg in the grain forming liquid phase, so as to fit the growth rate of silver halide grains. The pAg is to be in the range of 7.0 to 11.5, preferably 7.5 to 11.0, and more preferably 8.0 to 10.5. The flow rate can be selected by referring to JP-A 54-48521 and 58-49938.

A silver halide solvent known in the art such as ammonia, thioethers and thiourea may be employed in forming the tabular grains.

The tabular grains according to the invention may be grains forming latent images mainly on the grain surface or ones forming latent images mainly in the grain interior.

The tabular grains are prepared in the presence of a dispersing medium, i.e., in an aqueous solution containing a dispersing medium. The aqueous solution containing a dispersing medium is an aqueous solution in which a protective colloid is formed with gelatin or other compounds capable of forming a hydrophilic colloid (or materials capable forming a binder), and preferably an aqueous solution containing a colloidal protective gelatin.

Gelatins used as a protective colloid include alkali-processed gelatin and acid processed gelatin. Preparation of the gelatin is detailed in A. Veis, "The Macromolecular Chemistry of Gelatin", Academic Press (1964). Examples of hydrophilic colloids usable as a protective colloid other than gelatin include gelatin derivatives; graft polymers of gelatin and other polymers; proteins such as albumin and casein; cellulose derivatives such as hydroxyethylcellulose, carboxymethylcellulose and cellulose sulfuric acid ester; saccharine derivatives such as sodium alginate and starch derivatives; and synthetic hydrophilic polymeric materials such as homopolymers or copolymers of polyvinyl alcohol, polyvinyl alcohol partial acetal, poly-N-vinyl pyrrolidone, polyacrylic acid, polymethacrylic acid, polyacryl amide, polyvinyl imidazole, and polyvinyl pyrazole. There is preferably employed gelatin having a jelly strength of at least 200, as defined in the PAGI method.

After completing the grain growth, the tabular grain emulsion of the invention can be desalted to remove unnecessary soluble salts. The emulsion can also be desalted during grain growth, as described in JP-A 60-138538. Desalting can be conducted according to the method described in Research Disclosure (hereinafter, also denoted as RD) 17643, Section II. More specifically, to remove soluble salts from the emulsion after forming precipitates or completing physical ripening are preferably employed the noodle washing method by gelling gelatin and the flocculation method using inorganic salts, anionic surfactants (e.g., polystylenesulfonate) or gelatin derivatives (e.g., acylated gelatin, carbamoyl-modified gelatin).

The average silver iodide content of a silver halide grain group can be determined by the EPMA (or Electron Probe Micro Analyzer) method. Thus, a sample which is prepared by dispersing silver halide grains, which are not in contact with each other, is exposed to electron beams while cooled with liquid nitrogen to not higher than −100° C. Characteristic X-ray intensities of silver and iodine which are radiated from individual grains are measured to determine the silver iodide content of each grain. At least 50 grains are subjected to measurement and their average value is determined.

In the tabular grains according to the invention, distribution of the iodide content is preferably uniform among grains. When the iodide content distribution among grains is determined, the relative standard deviation thereof, i.e., a standard deviation of the silver iodide content of grains/average value×100%, is preferably 30% or less, and more preferably 20% or less.

In the invention, at least 50% of the projected area of total silver halide grams is accounted for by tabular grains requiring the condition that the silver iodide content gradually and continuously varies laterally outwardly from the center to the edge of the grain. The said condition can be measured by the EPMA method using beam with a narrow diameter. The condition is further detailed below.

When viewed vertically to the major faces of tabular grains, a line is drawn on the major face from the center vertically to the edge. Measuring points are set along the line at intervals of 5 to 15% of the line length and the iodide content at each of the points is measured in the direction vertical to the major face, i.e., the iodide content is measured with respect to a cylyndrical portion with a spot diameter of an electron beam and a grain thickness. In this case, the spot diameter of the electron beam must be narrowed to 40 nm or less. More strict condition that the silver iodide content gradually and continuously varies outwardly from the center to the edge is as follows. The measuring points are set along the line as explained above from center at intervals of 20 nm. Further, the spot diameter as mentioned above is also to be set as 20 nm. Taking into account possible damage of a sample, the measurement needs to be made at a temperature of not higher than −100° C. Measurement at each point is to be made over a period of 30 sec. or more. The variation in iodide content between two measuring points is shown as a difference of an iodide content (mol %) between the two points divided by the distance (nm) between the said two points. In this case, when the iodide content increases or decreases outwardly from the center, the variation is represented respectively as a positive or negative value. In the present invention, when the iodide content variation in the direction of from the center to the edge of the grain is within the range of −0.03 mol %/nm and +0.03 mol %)nm, it is defined that the iodide content gradually and continuously varies outwardly from the grain center to the grain edge. The iodide content variation is preferably within the range of −0.01 mol %/nm and +0.02 mol %/nm, and more preferably within the range of 0.00 mol %/nm and 0.01 mol %/nm.

Tabular grains in which the iodide content varies gradually and continuously, are to account for preferably at least 70%, and more preferably at least 90% of the total grain projected area.

Halide composition of the tabular grain surface can be determined by the XPS (X-ray Photoelectron Spectroscopy) method.

The XPS method is known as a technique for measuring the iodide content of the surface of silver halide grains, as disclosed in JP-A 2-24188. When measured at room temperature, however, X-ray irradiation destroys a sample so that the iodide content of the outermost surface can not be accurately determined. However, the inventors of the present invention succeeded in accurately determining the iodide content of the surface by cooling the sample to a temperature at which no destruction of the sample occurred. As a result, it was proved that, in core/shell grains which are different in composition between the interior and the surface, and grains in which a high iodide (or low iodide) layer is localized near the surface region, the value measured at room temperature is quite different from the true composition, due to decomposition of silver halide and diffusion of the halide (particularly, of the iodide).

The procedure of the XPS method employed in the invention is as follows. To an emulsion is added a 0.05% by weight proteinase aqueous solution and stirred at 45° C. for 30 min. to degrade the gelatin. After centrifuging and sedimenting the emulsion grains, the supernatant is removed. Then, distilled water is added thereto and the grains are redispersed. The resulting solution is coated on the mirror-finished surface of a silicon wafer to prepare a sample. Using the thus prepared sample, measurement of the surface iodide was conducted using the XPS method. In order to prevent sample destruction due to X-ray irradiation, the sample in the measuring chamber was cooled to −110 to −120° C., exposed to X-rays of Mg-Kα line generated at an X-ray source voltage of 15 kV and an X-ray source current of 40 mA and measured with respect to Ag3d5/2, Br3d and I3d3/2 electrons. From the integrated intensity of a measured peak which has been corrected with a sensitivity factor, the halide composition of the surface can be determined. In the invention, the interior of the grain is referred to as the internal region within the grain to a depth of 50 Å or more from the outermost surface.

In the tabular grains according to the invention, the silver iodide content of the grain surface is preferably higher than the average overall silver iodide content. Thus, the ratio of silver iodide content of grain surface/average silver iodide content is preferably between 1.1 and 8, and more preferably between 1.3 and 5.

The silver halide emulsion according to the invention is characterized in that at least 50% of the total grain projected area is accounted for by tabular grains having at least 30 dislocation lines per grain in the fringe portion. The grains having at least 30 dislocation lines per grain in the fringe portion preferably account for at least 60%, and more preferably at least 70% of the total grain projected area.

The dislocation lines in tabular grains can be directly observed by means of transmission electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. Silver halide tabular grains are taken out from an emulsion while ensuring to not apply such a pressure as to cause dislocation in the grains, and are placed on a mesh for electron microscopy. The sample is observed via transmission electron microscopy, while cooled to prevent the grain from being damaged (e.g., printing-out) by the electron beams. Since electron beam penetration is hampered as the grain thickness increases, sharper observation is obtained when using an electron microscope of a higher voltage (over 200 kV for 0.25 μm thick grains). From the thus-obtained electron micrograph, the position and number of the dislocation lines in each grain viewed perpendicularly to the major face can be determined.

In the invention, the expression "having dislocation lines in the fringe portion" means that the dislocation lines are present in the vicinity of peripheral portions of the tabular grain or in the vicinity of the edges or corners of the grain. More concretely, when the tabular grain is viewed vertically to its major face and the length of a line connecting the center of the major face and the corner of the grain is represented as L, the fringe portion means an outer region other than an inner region bounded by lines connecting points at a distance of 0.50L from the center on the line connecting the center and each of the corners. In this case, the center of the major face is referred to as the center of gravity of the major face.

In the preferred embodiment of the silver halide emulsion according to the invention, at least 50% of the total grain projected area is accounted for by tabular grains, in which the dislocation lines are localized only in the fringe portion of the grain. The tabular grains having dislocation lines only in the fringe portion account for preferably at least 60%, and more preferably at least 70% of the total grain projected area. The region in which the dislocation lines are localized is preferably an outer region other than an inner region bounded by lines connecting points at a distance of 0.70L (and more preferably 0.80L) from the center.

The dislocation lines are directed substantially outwardly from the center to the outer surface (side face), but often snakes.

The introduction of the dislocation lines into the tabular grains can be performed using any of the several well-known methods, including addition of an iodide ion containing aqueous solution such as a potassium iodide aqueous solution and a silver salt aqueous solution by the double jet method, addition of an iodide ion solution alone, addition of a fine iodide-containing silver halide grain emulsion, and addition of an iodide ion releasing agent described in JP-A 6-11781.

Of these, addition of an iodide ion releasing agent are preferred is effective to obtain the emulsion according to the invention. The iodide ion releasing agent is a compound capable of releasing an iodide ion upon reaction with a base or a nucleophilic agent, represented by the following formula:

$$R^1—I$$

in which $R^1$ is a univalent organic group. $R^1$ is preferably an alkyl group, an alkenyl group, an alkynyl group, an aryl group, an aralkyl group, a heterocyclic group, an acyl group, a carbamoyl group, an alkyloxycarbonyl group, an aryloxycarbonyl group, an alkylsulfonyl group, an arylsulfonyl group or a sulfamoyl group. $R^1$ is preferably an organic group having 30 or less carbon atoms, more preferably 20 or less carbon atoms, and still more preferably 10 or less carbon atoms. R1 is preferably substituted with a substituent. The substituent may be further substituted. Preferred examples of the substituent include a halogen atom, an alkyl group, an alkenyl group, an alkynyl group, an aryl group, an aralkyl group, a heterocyclic group, an acyl group, an acyloxy group, a carbamoyl group, an alkyloxycarbonyl group, an aryloxycarbonyl group, an alkylsulfonyl group, an arylsulfonyl group or a sulfamoyl group, alkoxy group, an aryloxy group, an amino group, an acylamino group, a ureido group, urethane group, a sulfonylamino group, sulfinyl group, a phosphoric acid amido group, an alkylthio group, a cyano group, sulfo group, carboxy group, a hydroxy group and a nitro group.

The iodide ion releasing agent, $R^1$—I is preferably iodoalkanes, an iodoalcohol, an iodocarboxylic acid, an iodoamide and their derivatives, and more preferably an iodoamide and an iodoalcohol including their derivatives. Iodoamides substituted by a heterocyclic group is still more preferred, and particularly, a(iodoacetoamido)-benzenesulfonate is most preferred.

Exemplary examples of the iodide ion releasing agent are shown below.

(1) $I(CH_2)_2OH$ (2) $I(CH_2)_3OH$ (3) $I(CH_2)_4OH$ (4) $ICH_2COOH$ (5) $I(CH_2)_2COOH$ (6) $I(CH_2)_3COOH$ (7) $ICH_2CONH_2$ (8) $I(CH_2)_2CONH_2$ (9) $I(CH_2)_3CONH_2$ (10)

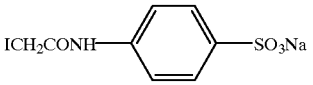

(11)

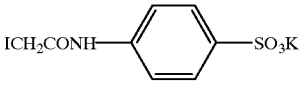

(12)

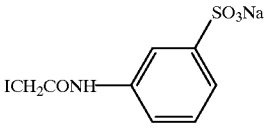

(13)

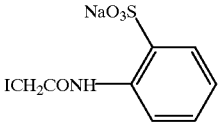

In cases when the iodide ion releasing agent is reacted with a nucleophilic agent to release an iodide ion, as a nucleophilic agent are preferably employed hydroxide ion, sulfite ion, thiosulfate ion, a sulfinate salt, a carboxylic acid salt, ammonia, amines, alcohols, ureas, thioureas, phenols, hydrazines, sulfides or hydroxamic acids. Of these are preferred hydroxide ion and sulfite ion.

It was found by the inventors of the present invention that the emulsion of the invention was prepared using the iodide ion releasing agent with adjusting conditions for releasing an iodide ion. Preferred iodide ion releasing reaction condition are as follows. In the iodide ion releasing reaction during preparation of the emulsion according to the invention, at least 50% of the iodide ion releasing agent added can releases iodide ions preferably within 30 to 180 sec. The iodide ion releasing rate can be measured by monitoring the pAg during reaction. The iodide ion releasing amount can be determined from the pAg employing a calibration curve which was previously prepared using an aqueous soluble iodide such as KI.

The iodide ion releasing rate can be controlled with an iodide ion releasing agent, an adding amount of a nucleophilic agent and its concentration, a molar ratio of the iodide ion releasing agent to the nucleophilic agent, a pH and a temperature. The reaction temperature is preferably not higher than 40° C., and more preferably not higher than 35° C. The pBr is preferably not more than 1.50, more preferably not more than 1.30, and still more preferably nit more than 1.10. The addition amount of the iodide ion releasing agent is preferably not more than 3.5 mol %, more preferably not more than 1.5 mol %, and still more preferably not more than 1.0 mol %, based on total silver amount after completing grain growth. In cases where a hydroxide ion is employed as a nucleophilic agent, the iodide ion releasing reaction is performed preferably at a pH of 9.0 to 12.0, and more preferably 10.0 to 11.0. In cases where a nucleophilic agent other than the hydroxide ion, the molar amount of the nucleophilic agent is preferably 0.25 to 2.0, more preferably 0.50 to 1.5, and still more preferably 0.80 to 1.2 times the iodide ion releasing agent amount, and the pH is preferably 8.5 to 10.5, and more preferably 9.0 to 10.0. The nucleophilic agent is added preferably after starting addition of the iodide ion releasing agent, and more preferably after completing addition of the iodide ion releasing agent.

In the invention, the dislocation line introducing position refers to the portion at which the iodide ion is introduced into the grain. The silver halide emulsion according to the invention comprises tabular grains each having an aspect ratio of 5 or more and further having 30 or more dislocation lines in the fringe portion, in which the silver iodide content gradually and continuously varied in the direction of from the center of the grain to the grain edge. The tabular grains preferably account for at least 30%, more preferably at least 40%, and still more preferably 50% of the total grain projected area.

In one embodiment of the invention, tabular grains each having a silver iodide border preferably account for less than 20% of the total projected area of silver halide grains. The tabular grains having the silver iodide border account for more preferably less than 15%, still more preferably less than 10%, still furthermore preferably less than 5%, and optimally 0% of the total grain projected area. In this case, at least 600 grains needs to be observed. The silver iodide border, which is a term defined in the present invention, can be observed in the same manner as for the dislocation lines. The silver iodide border is defined as a border line portion of a width of several nm to several 10 nm, which is observed, by TEM, near the dislocation line introducing position and has a form similar to that of the periphery of the grain. The iodide content at this portion measured by the EPMA method is 8 to 15 mol %. Thus, it is a high silver iodide containing phase, which is concurrently produced at the time of introducing the dislocation lines. As a result of difference in silver iodide content, the ratio of electron beam transmission to scattering is different from other portions, enabling them to be observed by TEM. An exemplary example of the silver iodide border is shown in FIG. 1.

In preferred embodiment of the invention, the tabular silver halide grains each contain at least a polyvalent metal compound in the fringe portion. Allowing the polyvalent metal compound to be occluded within the grain is called metal-doping or doping. The metal-doping is a known technique in the photographic art. It is reported by Leubner that doping an iridium complex into silver halide forms an electron trapping center (The Journal of Photographic Science Vol.31, 93, 1983). A metal compound used in metal-doping is called a metal dopant or simply a dopant. In the invention, one or more metal dopants can be occluded at any position within the grain. One preferred embodiment is to allow one or more polyvalent metal compounds to be contained in the fringe portion of the tabular grains.

Preferred examples of the metal dopant include compounds of metals, such as Mg, Al, Ca, Sc, Ti, V, Cr, Mn, Fe, Co, Ni, Cu, Zn, Ga, Ge, Sr, Y, Zr, Nb, Mo, Tc, Ru, Rh, Pd, Cd, Sn, Ba, Ce, Eu, W, Re, Os, Ir, Pt, Hg, Tl, Pd, Bi and In. A metal compound to be doped is selected preferably from simple salts and complex salts. In the case of metal complex salts, a six-coordinate complex, a five-coordinated complex, a four-coordinated complex and a two-coordinated complex are preferred, and an octahedral six-coordinate complex or a planar four-coordinate complex is more preferred. The complex may be a single nucleus complex or poly-nucleus complex. Examples of a ligand constituting the complex include $CN^-$, CO, $NO_2^-$, 1,10-phenthroline, 2,2'-bipyridine, $SO_3^-$, ethylenediamine, $NH_3$, pyridine, $H_2O$, $NCS^-$, $NCO^-$, $NO_3^-$, $SO_4^{2-}$, OH—, $CO_3^{2-}$, $SSO_3^{2-}$, $N_3^-$, $S_2^-$, F—, Cl—, Br— and $I^-$.

Preferred examples of the metal compound to be doped include $K_4Fe(CN)_6$, $K_3Fe(CN)_6$, $Pb(NO_3)_2$, $K_2IrCl_6$, $K_3IrCl_6$, $K_2IrBr_6$ and $InCl_3$.

Concentration distribution of the metal dopant within the grain can be determined by gradually dissolving the grain from the surface to the interior and measuring the dopant content at each portion. The following method is exemplarily explained below.

Prior to determination of the content of the polyvalent compound, a silver halide tabular grain emulsion is subjected to the following pre-treatment. To about 30 ml of the emulsion is added 50 ml of a 0.2% actinase aqueous solution and stirred continuously at 40° C. for 30 min. to perform degradation of the gelatin. This procedure is repeated five times. After centrifuging, washing is repeated five times with 50 ml of methanol, two times with 50 ml of 1N nitric acid solution and five times with ultra-pure water, and after centrifuging, only tabular grains are separated. A surface portion of the resulting tabular grains is dissolved with aqueous ammonia or pH-adjusted ammonia (in which the concentration of ammonia or the pH is varied according to the kind of silver halide and the dissolution amount). Of the tabular grains, for example, the outermost surface portion of silver bromide grains can be dissolved to an extent of about 3% from the surface, using 20 ml of 10% aqueous ammonia per 2 g of silver bromide grains. The amount of dissolved silver bromide can be determined in the following manner. After dissolving, the solution is subjected to centrifuging to separate any remaining silver bromide grains and the amount of silver contained in the resulting supernatant can be determined with a high frequency induction plasma mass-spectrometer (ICP-MS), a high frequency induction plasma emission spectral analyzer (ICP-AES) or an atomic absorption spectrometer. From the difference in the content of the polyvalent metal compound between the surface-dissolved silver bromide grains and the undissolved silver bromide grains, the amount of the polyvalent metal compound present in about the grain surface of 3% (i.e., it means that silver halide corresponding to about 3% of the total silver amount is dissolved from the surface). To determine the content of the polyvalent metal compound, after dissolving in an aqueous ammonium thiosulfate solution, aqueous sodium thiosulfate solution or aqueous potassium cyanide solution and the resulting solution, quantitative analysis is performed by an ICP-MS method, an ICP-AES method or an atomic absorption method. In the case when using potassium cyanide as a solvent and ICP-MS (FISON produced by Elemental Analysis Corp.) as an analyzer, for example, about 40 mg of tabular silver halide grains is dissolved in 5 ml of an aqueous 0.2N potassium cyanide solution, a solution of an internal standard element Cs is added thereto in an amount 10 ppb and a measuring sample is prepared further by adding ultra-pure water to make a total volume 100 ml. Using a calibration curve with respect to a polyvalent metal compound which has been prepared by the use of tabular silver halide grains free from the polyvalent metal compound, the content of the polyvalent metal compound contained in a sample is determined by the ICP-MS method. In this case, a measuring sample is diluted by 100 times with ultra-pure water and the silver content thereof is measured with the ICP-AES method or atomic absorption method. After dissolving the grain surface, the tabular grains is washed with ultra-pure water and the content of the polyvalent metal compound in the internal direction of the grain can be determined by repeating the dissolution of the grain surface in the same manner as described above. The metal doped in the peripheral region of the tabular grain can be determined by a combination of the ultra-thin slice preparation method aforementioned and the above-described metal determination.

The metal dopant occluded in the tabular grains is preferably $1\times10^{-9}$ to $1\times10^{-4}$ mol, and more preferably $1\times10^{-8}$ to $1\times10^{-5}$ mol per mol of silver halide. The ratio of the amount of the metal dopant occluded in the peripheral region to that occluded in the central region of the major face is preferably not less than 5, more preferably not less than 10, and still more preferably not less than 20.

The metal dopant can be occluded by adding, to the substrate grains, a fine silver halide grain emulsion which has previously metal-doped. In this case, the metal is doped preferably in an amount of $1\times10^{-7}$ to $1\times10^{-1}$ mol, and more preferably $1\times10^{-5}$ to $1\times10^{-3}$ mol per mol of fine silver halide grains. To allow the metal to be occluded into the fine grains, the fine grain emulsion is prepared by using a halide solution containing the metal dopant. The halide composition of the fine silver halide grains may be any one of silver bromide, silver iodide, silver iodobromide, silver chlorobromide and silver iodochlorobromide, and preferably is the same as that of the substrate grains.

The fine silver halide grains containing a metal dopant are deposited on the substrate grains at any time after completing fine grain formation and before starting chemical sensitization, and preferably at a time after completion of desalting and before starting chemical sensitization. The fine grains are deposited with the metal dopant onto the most active portion of the substrate grain, through adding a fine grain emulsion to the substrate grain emulsion in the state of a low salt concentration. As a result, the fine grains can effectively be deposited onto the peripheral region including the corner and edge of the tabular grains. In this case, the fine silver halide grains are not coagulated or adsorbed directly onto the substrate grains, but when the fine silver halide grains are concurrently present with the substrate grains, the fine grains are dissolved and recrystalized onto the substrate grains. When a part of an emulsion obtained by the method described above is taken out and observed by an electron microscope, the fine grains can not be observed and any epitaxially protruded portion is not observed on the substrate grain surface.

The fine silver halide grains are added preferably in an amount of $1\times10^{-7}$ to 0.5 mol, and more preferably $1\times10^{-5}$ to $1\times10^{-1}$ mol per mol of the substrate grains. The physical ripening condition to deposit the fine silver halide grains is optionally selected at 30 to 70° C. and over a period of 10 to 60 min.

In one preferred embodiment of the invention, at least a part of the tabular grains contained in the silver halide emulsion according to the invention, internally contain reduction sensitization center. The statement "internally contain reduction sensitization center" means having fine silver nucleus formed by reduction sensitization in the interior of the grain, and this accomplished by subjecting to reduction sensitization treatment before completing silver halide grain growth. The interior of the grain an inner portion of 90% or less of the grain volume and preferably 70% or less, and still more preferably 50% or less.

The reduction sensitization is conducted by adding a reducing agent to a silver halide emulsion or a reaction mixture for growing grains. Alternatively, the silver halide emulsion or mixture solution is subjected to ripening or grain growth at a pAg of 7 or less, or at a pH of 7 or more. These methods may be combined. Of these, the method of adding a reducing agent is preferred. As a preferable reducing agent are cited thiourea dioxide, ascorbic acid or its derivative, and a stannous salt. Furthermore, a borane compound, hydrazine derivative, formamidine sulfinic acid, silane compound, amine or polyamine and sulfite are cited. The addition amount thereof is preferably $10^{-8}$ to $10^{-2}$ mol, and more preferably $10^{-6}$ to $10^{-4}$ mol per mol of silver halide.

To conduct ripening at a low pAg, there may be added a silver salt, preferably aqueous soluble silver salt. As the aqueous silver salt is preferably silver nitrate. The pAg in the ripening is 7 or less, preferably 6 or less and more preferably 1 to 3 (herein, $pAg=-\log[Ag^+]$). Ripening at a high pH is conducted by adding an alkaline compound to a silver halide emulsion or reaction mixture solution for growing grains. As the alkaline compound are usable sodium hydroxide, potassium hydroxide, sodium carbonate, potassium carbonate and ammonia. In a method in which ammoniacal silver nitrate is added for forming silver halide, an alkaline compound other than ammonia is preferably employed because of lowering an effect of ammonia.

The silver salt or alkaline compound may be added instantaneously or over a period of a given time. In this case, it may be added at a constant rate or accelerated rate. It may be added dividedly in a necessary amount. It may be made present in a reaction vessel prior to the addition of aqueous-soluble silver salt and/or aqueous-soluble halide, or it may be added to an aqueous halide solution to be added. It may be added apart from the aqueous-soluble silver salt and halide.

Silver halide grains contained in the emulsion according to the invention preferably contain a silver chalcogenide nucleus containing layer in the interior of the grain. The silver chalcogenide nucleus containing layer is located preferably in an outer region other than an inner region of 50% (more preferably 70%) of the grain volume. The silver chalcogenide nucleus containing layer may be or not in contact with the grain surface. The silver chalcogenide nucleus contained in the silver chalcogenide nucleus containing layer is definitely distinguished from a chalcogenide chemical sensitization nucleus, in a point that it forms a latent image forming center or not. Thus, the silver chalcogenide nucleus is lower in electron trapping capability than the chemical sensitization nucleus. The silver chalcogenide nucleus meeting such requirements can be formed according to a method described later. The silver chalcogenide nucleus containing layer is located preferably in the outside of the dislocation line introducing portion.

The silver chalcogenide nucleus can be formed by adding a compound capable of releasing a chalcogen ion. The silver chalcogenide nucleus is preferably a silver sulfide nucleus, silver selenide nucleus and silver telluride nucleus, and more preferably a silver sulfide nucleus. The compound capable of releasing a chalcogen ion is preferably a compound capable of releasing a sulfide ion, a selenide ion or a telluride ion. Preferred examples of the compound capable of releasing a sulfide ion include a thiosulfonic acid compound, a disulfide compound, a thiosulfate, a sulfide, a thiocarbamate compound, thioformaldehyde compound and a rhodanine compound. The compound capable of releasing a selenide ion is preferably a compound known as a selenium sensitizer. Preferred examples thereof include colloidal selenium single body, isoselenocyanates (e.g., allylisoselenocyanate) selenoureas (e.g., N,N-dimethylselenourea, N,N,N-triethylselenourea, N,N,,N-trimethyl-N-heptafluoroselenourea, N,N,N-trimethyl-N-heptafluoropropylcarbonyllselenourea, N,N,N-trimethyl-N-4-nitrophenylcarbonylselenourea), selenoketones (e.g., selenoacetoamide, N,N-dimethylselenobenzamide), selenophosphates (e.g., tri-p-triselenophosphate) and selenides (e.g., diethyl selenide, diethyl diselenide, triethylphosphine selenide). Preferred compounds capable of releasing a telluride ion include telluroureas (e.g., N,N-dimethyltellurourea, tetramethyltellurourea, N-carboxyethyl-N,N-dimethyltellurourea), phosphine tellurides (e.g., tributylphosphine telluride, tricyclohexylphosphine telluride, triisopropylphosphine telluride), telluroamides (e.g., telluroacetoamide, N,N-dimethyltellurobenzamide), telluroketones, telluroesters and isotellurocyanates.

As the chalcogen ion releasing compounds is particularly preferred a thiosulfonic acid compound represented by the following formulas [1] to [3]:

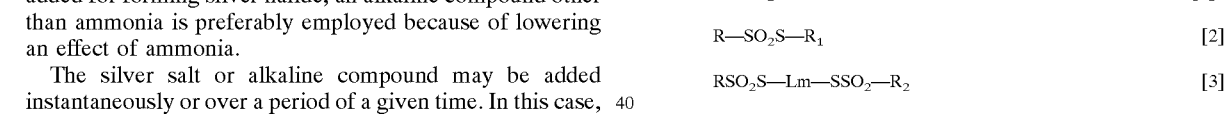

$$R—SO_2S—M \quad [1]$$

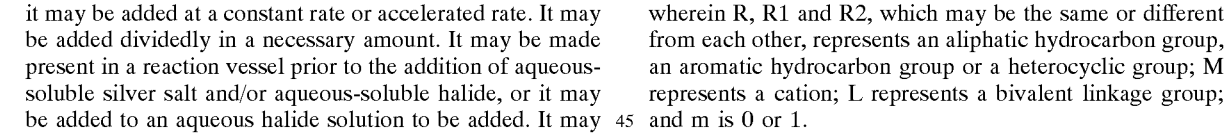

$$R—SO_2S—R_1 \quad [2]$$

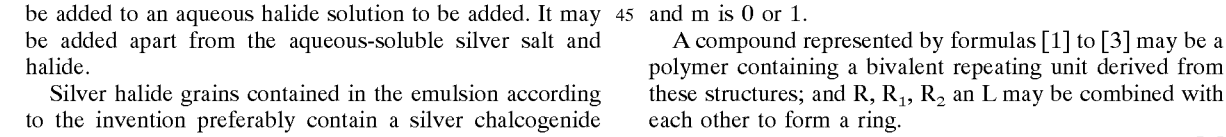

$$RSO_2S—Lm—SSO_2—R_2 \quad [3]$$

wherein R, R1 and R2, which may be the same or different from each other, represents an aliphatic hydrocarbon group, an aromatic hydrocarbon group or a heterocyclic group; M represents a cation; L represents a bivalent linkage group; and m is 0 or 1.

A compound represented by formulas [1] to [3] may be a polymer containing a bivalent repeating unit derived from these structures; and R, $R_1$, $R_2$ an L may be combined with each other to form a ring.

The thiosulfonate compound represented by formulas [1] to [3] will be explained more in detail. In case of R, $R_1$ and $R_2$ being an aliphatic group, they are a saturated or unsaturated, straight or branched, or cyclic aliphatic hydrocarbon group; preferably, an alkyl group having 1 to 22 carbon atoms (e.g., methyl, ethyl, propyl, butyl, pentyl, hexyl, octyl, 2-ethylhexyl, decyl, dodecyl, hexadecyl, octadecyl, cyclohexyl, isopropyl, t-butyl, etc.); an alkenyl group having 2 to 22 carbon atoms (allyl, butenyl, etc.) and an alkynyl group (propargyl, butynyl etc.). These group may be substituted. In case of R, $R_1$ and $R_2$ being an aromatic group, they include a monocyclic and condensed ring, aromatic hydrocarbon groups, preferably those having 6 to 20 carbon atoms such as phenyl. These may be substituted. In case of R, $R_1$ and $R_2$ being a heterocyclic group, they contain at least one selected from nitrogen, oxygen, sulfur, selenium and tellurium atoms, being each 3 to 15-membered ring (preferably, 3 to 6-membered ring) having at least one carbon atom, such as pyrroridine, piperidine, pyridine, tetrahydrofuran, thiophene, oxazole, thiazole, imidazole, benzothiazole, benzooxazole, benzimidazole, selenazole, benzoselenazole, tetrazole, triazole, benzotriazole, oxadiazole and thiadiazole. As a substituent for R, $R_1$ and $R_2$, are cited an alkyl group (e.g., methyl, ethyl, hexyl etc.), alkoxy group (e.g., methoxy, ethoxy, octyloxy, etc.), aryl group (e.g., phenyl, naphthyl, tolyl etc.), hydroxy group, halogen atom (e.g., fluorine, chlorine, bromine, iodine), aryloxy group (e.g., pheoxy), alkylthio (e.g., methylthio, butylthio), arylthio group (e.g., phenylthio), acyl group (e.g., acetyl, propionyl, butylyl, valeryl etc.), sulfonyl group (e.g., methylsulfonyl, phenylsulfonyl), acylamino group (e.g., acetylamino, benzoylamino), sulfonylamino group (e.g., methanesulfonylamino, benzenesulfonylamino, etc.), acyloxy group (e.g., acetoxy, benzoxy, etc.), carboxy group, cyano group, sulfo group, amino group. —$SO_2SM$ group (M is a monovalent cation) and —$SO_2R_1$.

A bivalent linkage group represented by L is an atom selected from C, N, S and O or an atomic group containing at least one of them. Examples thereof are an alkylene group, alkenylene group, alkynylene group, arylene group, —O—, —S—, —NH—, —CO— or —$SO_2$—, or a combination thereof.

L is preferably a bivalent aliphatic or aromatic group.

Examples of the aliphatic group include

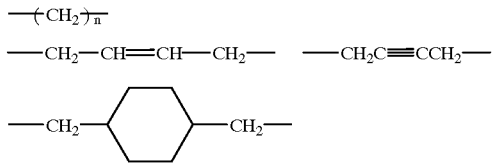

(n = 1–12)

and xylylene group. As the aromatic group, are cited phenylene group and naphthylene group. These groups may have a substituent as afore-described.

M is preferably a metallic ion or organic cation. As the metallic ion are cited lithium ion, sodium ion and potassium ion. As the organic cation are cited an ammonium ion (e.g., ammonium, tetramethyammonium, tetrabutylammonium, etc.), phosphonium ion (e.g., tetraphenylphosphonium) and guanidyl group.

In the case where a compound represented by formulas (1) to (3) is a polymer, a repeating unit thereof is as follows. These polymer may be a homopolymer or copolymer with other copolymerizing monomers.

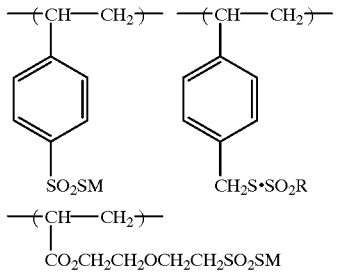

-continued

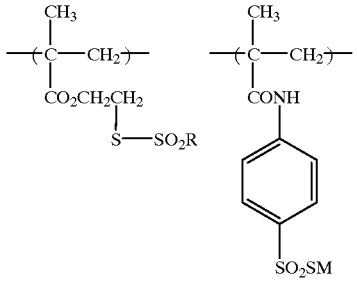

Examples of the compounds represented by formulas (1) to (3) are described in JP-A 54-1019, British Patent No. 972,211 and Journal of Organic Chemistry vol.53, page 396 (1988).

The chalcogen ion releasing compound is added to form the silver chalcogenide nucleus, in an amount of $10^{-8}$ to $10^{-2}$ mol, and more preferably $10^{-6}$ to $10^{-3}$ mol per mol of silver halide. The chalcogen ion releasing compound may be added instantaneously or over a period of time. The compound may be added at a constant flow rate or a variable flow rate. The compound may separately be added. Formation of the silver chalcogenide nucleus must be completed before completing grain growth. A silver chalcogenide nucleus formed after completion of the grain growth, which is incorporated as a part of chemical sensitization nuclei formed in the chemical sensitization process, does not substantially contribute to effect of the present invention. Similarly, in cases when internally chemical-sensitized, a silver chalcogenide nucleus formed on the same face as in chemical sensitization, does not substantially contribute to effect of the present invention.

The silver halide emulsion according to the invention may be added with an oxidizing agent during the preparation process. The oxidizing agent used in the invention refers to a compound capable of acting metallic silver to convert to silver ions. The oxidizing agent may be an organic or inorganic compound. As examples of inorganic oxidizing agents are cited ozone, hydrogen peroxide and its adduct (e.g., $NaBO_2$—$H_2O_2$—$3H_2O$, $2NaCO_3$—$3H_2O_2$, $Na_4P_2O_7$—$2H_2O_2$, $2Na_2SO_4$—$H_2O_2$—$H_2O$), peroxy acid salt (e.g., $K_2S_2o_8$, $K_2C_2O_6$, $K_4P_2O_8$), peroxy complex compound (e.g., $K_2[Ti(O_2)C_2O_4]3H_2O$, $4K_2SO_4Ti(O_2)OHSO_42H_2O$, $Na_3[VO(O_2)(C_2O_4)_2]6H_2O$), oxy acid salt such as permanganate salt (e.g., $KMnO_4$) or chromate salt ($K_2Cr_2O_7$), halogen elements such as iodine and bromine, perhalogenate salt (e.g., potassium periodate), polyvalent metal salt (e.g., potassium ferric hexacyanate) and thiosulfonate. As examples of organic oxidizing agent are cited a quinone such as p-quinone, organic peroxide such as peracetic acid or perbenzoic acid and a compound capable of releasing an active halogen (e.g., N-bromsucciimide, chloramine T, chloramine B). Of these are preferred halogen elements and iodine is particularly preferred The oxidizing agent is added preferably in an amount of $1\times10^{-5}$ to $1\times10^{-2}$ mol, and more preferably $1\times10^{-4}$ to $1\times10^{-3}$ mol per mol of silver. Specifically, iodine is optimally added in an amount of $5\times10^{-5}$ to $5\times10^{-4}$ mol per mol of silver.

The silver halide emulsion according to the invention can be used, in an emulsion layer, singly or in combination with another silver halide emulsion. In cases where the emulsion of the invention is mixedly used with other emulsions) in the same layer, it is preferred that plural emulsions different in average grain size are mixedly used. In cases where the emulsion according to the invention is used in two or more emulsion layers having the same spectral sensitivity, the average grain size of an emulsion contained in each layer is preferably different from each other. In cases where used in two or more emulsion layers having different spectral sensitivity and similar speed, the average grain size of an emulsion contained in each layer is preferably close to each other. The silver halide emulsion according to the invention can be applicable to any emulsion layer.

The emulsion according to the invention can be chemically sensitized according to the conventional method. Sulfur sensitization, selenium sensitization and a gold sensitization by use of gold or other noble metal compounds can be employed singly or in combination. The emulsion can be spectrally sensitized to a wanted wavelength region by use of sensitizing dyes known in the art. The sensitizing dye can be employed singly or in combination thereof. There may be incorporated, with the sensitizing dye, a dye having no spectral sensitizing ability or a supersensitizer which does not substantially absorb visible light and enhances sensitization of the dye.

An antifoggant and stabilizer can be added into the tabular grain emulsion. Gelatin is preferably employed as a binder. An emulsion layer or other hydrophilic colloid layers can be hardened with hardeners. A plasticizer or a dispersion of a water-soluble or water-insoluble polymer (so-called latex) can be incorporated.

The silver halide emulsion according to the invention can be employed in photographic materials, and preferably in color photographic materials including a color film for general use or for cine, color paper, color reversal film, and color reversal paper.

In a silver halide emulsion layer of the color photographic material, a coupler can be employed. There can also be employed a competing coupler having an effect of color correction and a compound which, upon coupling reaction with an oxidation product of a developing agent, is capable of releasing a photographically useful fragment, such as a developing accelerator, a developing agent, a silver halide solvent, a toning agent, hardener, a fogging agent, a chemical sensitizer, a spectral sensitizer and a desensitizer.

A filter layer, anti-halation layer or anti-irradiation layer can be provided in the photographic material relating to the invention. In these layers and/or an emulsion layer, a dye which is leachable from a processed photographic material or bleachable during processing, can be incorporated. Furthermore, a matting agent, lubricant, image stabilizer, formalin scavenger, UV absorbent, brightening agent, surfactant, development accelerator or development retarder is also incorporated into the photographic material. Employed may be, as a support, polyethylene-laminated paper, polyethylene terephthalate film, baryta paper or cellulose triacetate film.

EXAMPLE

Embodiments of the present invention will be further explained, based on examples but the invention is not limited to these examples.

Example 1

(1) Preparation of Comparative Emulsion EM-1 Nucleation Stage

The following reaction mother liquor (Gr-1) contained in a reaction vessel was maintained at 30° C. and adjusted to a pH of 1.96 with a 1N sulfuric acid aqueous solution, while stirring at a rotation speed of 400 r.p.m. with a stirring mixer apparatus described in JP-A 62-160128. Thereafter, solutions (S-1) and (H-1), each 178 ml are added by the double jet addition at a constant flow rate for a period of 1 min. to form nucleus grains.

| | | |
|---|---|---|
| (Gr-1) | Alkali-processed gelatin (average molecular weight of 100,000) | 40.50 g |
| | Potassium bromide | 12.40 g |
| | Distilled water to make | 16.2 l |
| (S-1) | Silver nitrate | 862.5 g |
| | Distilled water to make | 4.06 l |
| (H-1) | Potassium bromide | 604.5 g |
| | Distilled water to make | 4.06 l |

Ripening Stage

After completing the above nucleation stage, solution (G-1) was added thereto and the temperature was raised to 60° C. in 30 min., while the silver potential of the emulsion within the reaction vessel (which was measured with a silver ion selection electrode using a saturated silver-silver chloride electrode, as a reference electrode) was controlled at 6 mV. Subsequently, the pH was adjusted to 9.3 with an aqueous ammonia solution and after maintained for 7 min., the pH was adjusted to 6.1 with an acetic acid aqueous solution, while the silver potential was maintained at 6 mV.

| (G-1) | |
|---|---|
| Alkali-processed gelatin (average molecular weight of 100,000) | 173.9 g |
| $HC(CH_2CH_2O)m(CH(CH_3)CH_2O)_{19.8}(CH_2CH_2O)nH$ (m + n = 9.77, Compound EO) 10% ethanol solution | 5.80 ml |
| Distilled water to make | 4.22 l |

Growth Stage

After completing the ripening stage, solutions (S-1) and (H-1) described above were added by the double jet addition at an accelerated flow rate (12 times faster at the end than at the start) for a period of 37 min. After completing addition, solution (G-2) was added and the stirring speed was adjusted to 550 r.p.m., then, 2.11 l of solution (and solution (H-2) were added by the double jet addition at an accelerated flow rate (2 times faster at the end than at the start) for a period of 40 min., while the silver potential of the emulsion was maintained at 6 mV. After completing addition, the temperature of the reaction mixture was lowered to 40° C. in 15 min., then, the silver potential was adjusted to −39 mV (pBr of 1.29) with a 3N potassium bromide aqueous solution. Subsequently, after adding solution (K-1) of 407.5 g, residual solution (S-2) and (H-3) were added by the double jet addition at an accelerated flow rate (1.2 times faster at the end than at the start, and the flow rate was discontinuously varied at the time fine grains disappeared) for a period of 25 min.

| | |
|---|---|
| (S-2) | |
| Silver nitrate | 2137.5 g |
| Distilled water to make | 3.60 l |
| (H-2) | |
| Potassium bromide | 859.5 g |
| Potassium iodide | 24.45 g |
| Distilled water to make | 2.11 l |

-continued

| | |
|---|---|
| (H-3) | |
| Potassium bromide | 620.6 g |
| Distilled water to make | 1.49 l |
| (G-2) | |
| Ossein gelatin | 284.9 g |
| Compound EO (10% ethanol solution) | 7.75 ml |
| Distilled water to make | 1.93 1 |
| (K-1) | |
| Potassium iodide | 38.1 g |
| Distilled water to make | 183.6 ml |

After completing grain growth, the emulsion was desalted according to the method described in JP-A 5-72658. Then, gelatin was further added thereto to redisperse the emulsion and the pH and pAg were adjusted to 5.80 and 8.05, respectively. The resulting emulsion was denoted as EM-1.

As a result of electronmicroscopic observation, it was proved that the resulting emulsion was comprised of tabular grains having an average diameter of 1.50 $\mu$m (average of equivalent circle diameter), an aspect ratio of 7.4 at 50% of the total grain projected area (i.e., 50% of the total grain projected area being accounted for tabular grains having an aspect ratio of 7.4 or more), a variation coefficient of grain diameter distribution of 15.0% and a variation coefficient of thickness of 21.2%.

(2) Preparation of Comparative Emulsion EM-2

Emulsion EM-2 was prepared in the same manner as in emulsion EM-1. except that in the growth stage, the temperature after being lowered was 55° C. and subsequently the EAg was adjusted to −30 mV (pBr of 1.29). As a result of electronmicroscopic observation, it was proved that emulsion Em-2 was the same in the average diameter, aspect ratio, variation coefficient of grain diameter and variation coefficient of grain thickness as those Em-1.

(3) Preparation of Comparative Emulsion EM-3

Figure 2:
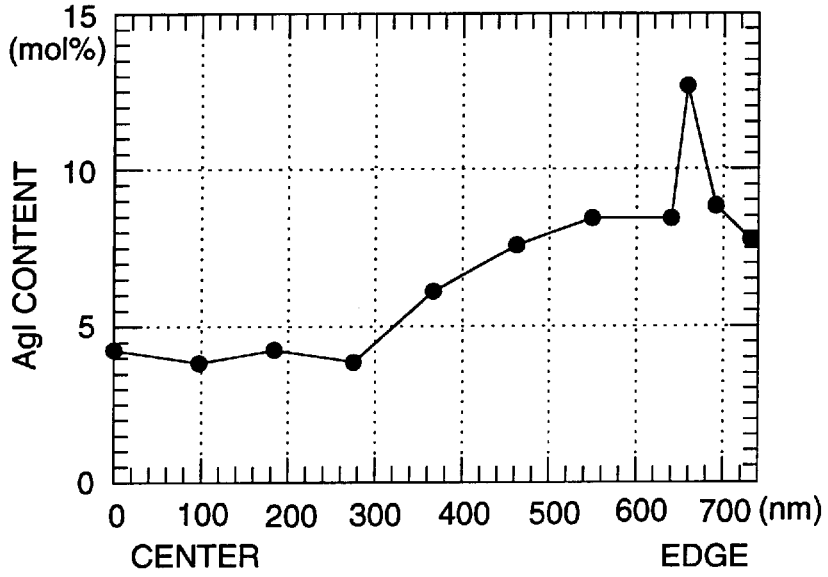
FIGS. 2 and 3 illustrate variation of the silver iodide content within a silver halide grain in the direction from the center to the edge.
Figure 4:
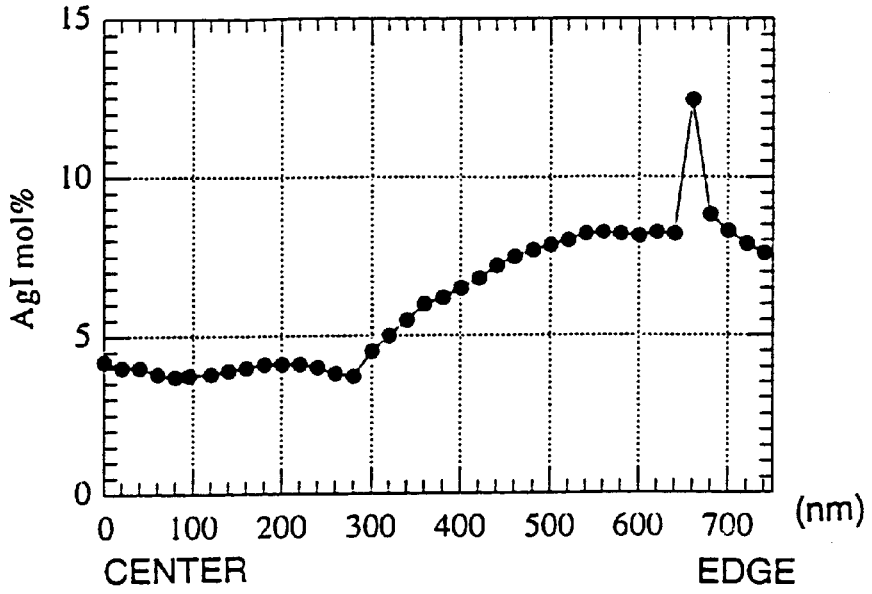
FIG. 4 illustrates variation of the silver iodide content within a silver halide grain in the direction from the center to the edge for the same grain as shown in FIG. 2 as measured by 20 nm interval measurement points

Emulsion EM-3 was prepared in the same manner as in emulsion EM-1, except that the growth stage was conducted in the following manner. As a result of electronmicroscopic observation, it was proved that emulsion Em-3 was the same in the average diameter, aspect ratio, variation coefficient of grain diameter and variation coefficient of grain thickness of Em-1. Further, in FIG. 2 is shown the silver iodide content within the grain at a distance extending outwardly from the center to the edge of the grain. As apparent from FIG. 2, the silver iodide content abruptly varies at the points within the range of 640 to 690, and the silver iodide content variation was not less than 0.2 mol %/nm. FIG. 4 shows the silver iodide content variation with the same grain as measured by the measuring point intervals of 20 nm.

Growth Stage

After completing the ripening stage, solutions (S-1) and (H-1) described above were added by the double jet addition at an accelerated flow rate (12 times faster at the end than at the start) for a period of 37 min. After completing addition, solution (G-2) was added and the stirring speed was adjusted to 550 r.p.m., then, 2.11 l of solution (S-3) and solution (H-2) were added by the double jet addition at an accelerated flow rate (2 times faster at the end than at the start) for a period of 40 min., while the silver potential of the emulsion was maintained at 6 mV. After completing addition, the temperature of the reaction mixture was lowered to 40° C. in 15 min., then, the silver potential was adjusted to −40 mV (pBr of 1.29) with a 3N potassium bromide aqueous solution. Subsequently, after adding solution (F-1) of 407.5 g, residual solution (S-3) and (H-4) were added by the double jet addition at an accelerated flow rate (1.2 times faster at the end than at the start, and the flow rate was discontinuously varied at the time fine grains disappeared) for a period of 25 min.

| | |
|---|---|
| (S-3) | |
| Silver nitrate | 2098.5 g |
| Distilled water to make | 3.53 l |
| (H-2) | |
| Potassium bromide | 859.5 g |
| Potassium iodide | 24.45 g |
| Distilled water to make | 2.11 l |
| (H-4) | |
| Potassium bromide | 591.5 g |
| Distilled water to make | 1.42 l |
| (G-2) | |
| Ossein gelatin | 284.9 g |
| Compound EO (10% ethanol solution) | 7.75 ml |
| Distilled water to make | 1.93 l |
| (F-1) | |
| Fine grain emulsion comprised of 3 wt % gelatin and silver iodide grains (av. size of 0.05 $\mu$m) | 407.5 g |

The above emulsion was prepared in the following manner. To 5000 ml of a 6.0 wt. % gelatin solution containing 0.06 mol of potassium iodide, an aqueous solution containing 7.06 mol of silver nitrate and an aqueous solution containing 7.06 mol of potassium iodide, 2000 ml of each were added over a period of 10 min., while the pH was maintained at 2.0 using nitric acid and the temperature was maintained at 40° C. After completion of grain formation, the pH was adjusted to 6.0 using a sodium carbonate aqueous solution. The finished weight of the emulsion was 12.53 kg.

(4) Preparation of Comparative Emulsion Em-4

Emulsion M4-4 was prepared in the some manner as in emulsion EM-3. except that in the growth stage, the temperature after being lowered was 55° C. and subsequently the EAg was adjusted to −30 mV (pBr of 1.29). As a result of electronmicroscopic observation, it was proved that emulsion Em-4 was the same in average diameter, aspect ratio, variation coefficient of grain diameter and variation coefficient of grain thickness as those of Em-3.

(5) Preparation of Inventive Emulsion Em-5

Figure 3:
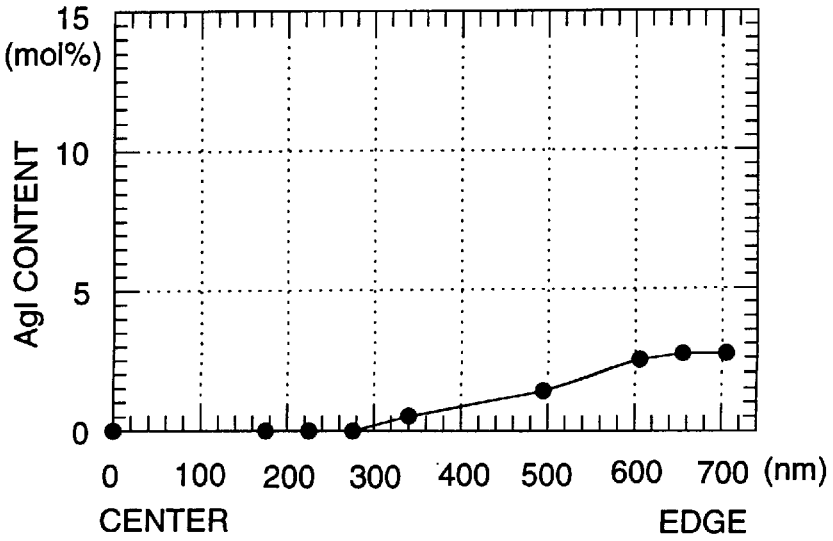
Figure 5:
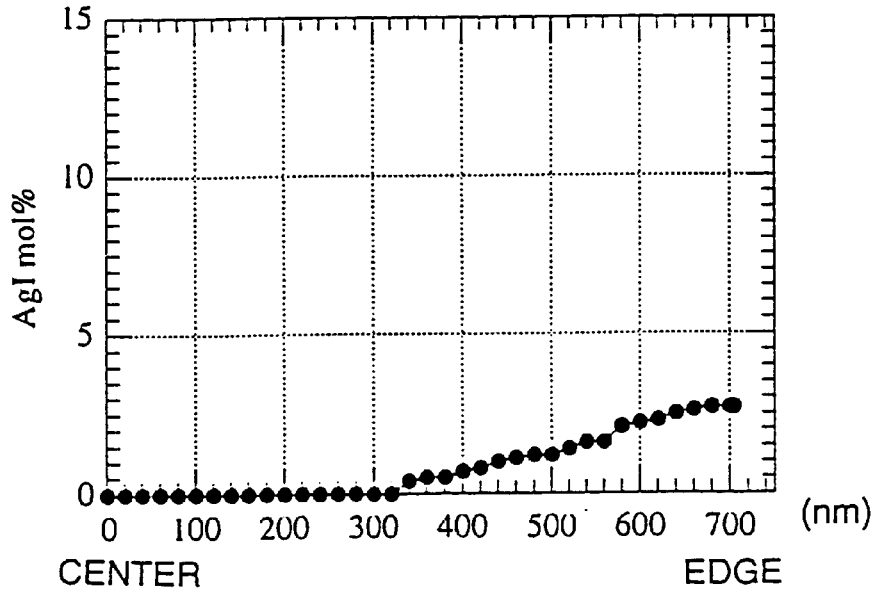
FIG. 5 illustrates variation or the silver iodide content within a silver halide grain in the direction from the center to the edge for the same grain as shown in FIG. 3 as measured by 20 nm interval measurement points.

Emulsion EM-5 was prepared in the same manner as in emulsion EM-1, except that the growth stage was conducted in the following manner. As a result of electronmicroscopic observation, it was proved that emulsion Em-5 was the same in average diameter, aspect ratio, variation coefficient of grain diameter and variation coefficient of grain thickness as those Em-1. Further, in FIG. 3 is shown the silver iodide content within the grain at a distance extending outwardly from the center to the edge of the grain. Also, FIG. 5 shows the sliver halide content variation within the same grain as measured by the measuring point intervals of 20 nm. As apparent from FIG. 3, and more strictly by from FIG. 5, the silver iodide content variation was small and within the range of −0.03 and +0.03 mol %/nm.

Growth Stare

After completing the ripening stage, solutions (S-1) and (H-1) described above were added by the double jet addition at an accelerated flow rate (12 times faster at the end than at the start) for a period of 37 min. After completing addition, solution (G-2) was added and the stirring speed was adjusted to 550 r.p.m., then, 2.11 l of solution (S-3) and solution (H-2) were added by the double jet addition at an accelerated flow rate (2 times faster at the end than at the start) for a period of 40 min., while the silver potential of the emulsion was maintained at 6 mV. After completing addition, the temperature of the reaction mixture was lowered to 40° C. in 15 min. Thereafter, solution (Z-1), containing an iodide ion releasing agent and solution (SS-1) containing a nucleophilic agent were added and the pH was adjusted to 9.3 with a potassium hydroxide aqueous solution. Then, the silver potential was adjusted to −40 mV (pBr of 1.29) with a 3N potassium bromide aqueous solution. Subsequently, after adding solution (F-1) of 407.5 g, residual solution (S-3) and (H-4) were added by the double jet addition at an accelerated flow rate (1.2 times faster at the end than at the start, and the flow rate was discontinuously varied at the time fine grains disappeared) for a period of 25 min.

| | |
|---|---|
| (S-2) | |
| Silver nitrate | 2137.5 g |
| Distilled water to make | 3.60 l |
| (H-2) | |
| Potassium bromide | 859.5 g |
| Potassium iodide | 24.45 g |
| Distilled water to make | 2.11 l |
| (H-3) | |
| Potassium bromide | 620.6 g |
| Distilled water to make | 1.49 l |
| (G-2) | |
| Ossein gelatin | 284.9 g |
| Compound EO (10% ethanol solution) | 7.75 ml |
| Distilled water to make | 1.93 l |
| (Z-1) | |
| Sodium p-iodoacetoamidobenzenesulfonate | 83.4 g |
| Distilled water to make | 1.0 l |
| (SS-1) | |
| Sodium sulfite | 28.0 g |
| Distilled water to make | 0.31 l |

(6) Preparation of Comparative Emulsion Em-6

Emulsion EM-6 was prepared in the same manner as in emulsion EM-5, except that in the growth stage, the temperature after being lowered was 55° C. and the EAg subsequent to the iodide ion releasing reaction was adjusted to −30 mV (pBr of 1.29). As a result of electronmicroscopic observation, it was proved that emulsion Em-6 was the same in average diameter, aspect ratio, variation coefficient of grain diameter and variation coefficient of grain thickness as those of Em-1.

(7) Preparation of Inventive Emulsion Em-7

Emulsion EM-7 was prepared in the same manner as in emulsion EM-5, except that solutions (Z-1) and (SS-1) in the growth stage were replaced by solutions (Z-2) and (SS-2), respectively. As a result of electronmicroscopic observation, it was proved that emulsion Em-7 was the same in average diameter, aspect ratio, variation coefficient of grain diameter and variation coefficient of grain thickness as those of Em-1.

| | |
|---|---|
| (Z-2) | |
| Sodium p-iodoacetoamidobenzenesulfonate | 57.7 g |
| Distilled water to make | 1.0 l |
| (SS-2) | |
| Sodium sulfite | 20.0 g |
| Distilled water to make | 0.3 l |

(8) Preparation of Comparative Emulsion Em-8

Emulsion EM-8 was prepared in the same manner as in emulsion EM-1, except that in the growth stage solution (K-1) was not added. As a result of electronmicroscopic observation, it was proved that emulsion Em-8 was the same in average diameter, aspect ratio, variation coefficient of grain diameter and variation coefficient of grain thickness as those of Em-1.

(9) Chemical Sensitization/Spectral Sensitization of Emulsion

Emulsions Em-1 to Em-8 each were added with sensitizing dyes SSD-1, SSD-2 and SSD-3, while being maintained at 52° C. After ripened for 20 min., sodium thiosulfate was added thereto and were further added chloroauric acid and potassium thiocyanate. After the emulsions each were ripen until reached an optimum sensitivity-fog relationship, 1-phenyl-5-mercaptotetrazole and 4-hydroxy-6-methyl-1,3,3a,6-tetraazaindene was added to stabilize the emulsions. The addition amount of each of the sensitizing dyes, sensitizers and stabilizer and the ripening time were set so as to obtain an optimum sensitivity-fog relationship at 1/200 sec. exposure.

(10) Preparation/Evaluation of Sample

To each of emulsions Em-1 to Em-8 which were subjected to sensitization, an emulsified dispersion in which a coupler MCP-1 was dissolved in ethylacetate and tricresylphosphate and dispersed in a gelatin aqueous solution, and photographic adjuvants such as a coating aid and a hardener were added to prepare a coating solution. The coating solutions each were coated on a subbed cellulose triacetate film support according to the conventional manner and dried to obtain color photographic material samples 101 to 108.

SSD-1

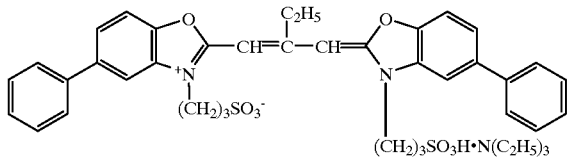

SSD-2

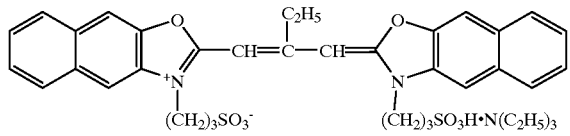

SSD-3

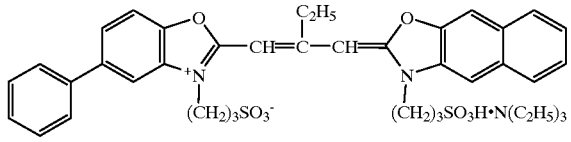

-continued

MCP-1

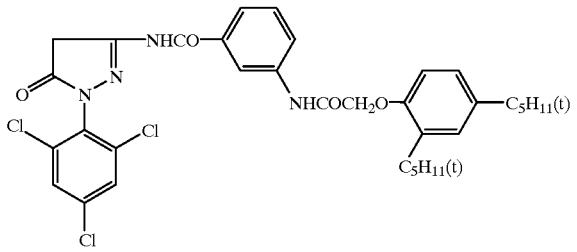

The samples each were exposed to light at a color temperature of 5,400° K. through a glass filter Y-48 (available from Toshiba) and processed according the following process.

| Processing: Processing step | Time | Temperature | Replenishing rate* |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 1 min. | 38 ± 5.0° C. | 830 ml |
| Drying | 1 min. | 55 ± 5.0° C. | — |

*: Amounts per $m^2$ of photographic material

A color developer, bleach, fixer and stabilizer each were prepared according to the following formulas.

Color developer and replenisher thereof:

| | Worker | Replenisher |
|---|---|---|
| Water | 800 ml | 800 ml |
| Potassium carbonate | 30 g | 35 g |
| Sodium hydrogencarbonate | 2.5 g | 3.0 g |
| Potassium sulfite | 3.0 g | 5.0 g |
| Sodium bromide | 1.3 g | 0.4 g |
| Potassium iodide | 1.2 mg | — |
| Hydroxylamine sulfate | 2.5 g | 3.1 g |
| Sodium chloride | 0.6 g | — |
| 4-Amino-3-methyl-N-(β-hydroxyethyl)-aniline sulfate | 4.5 g | 6.3 g |
| Diethylenetriaminepentaacetic acid | 3.0 g | 3.0 g |
| Potassium hydroxide | 1.2 g | 2.0 g |

Water was added to make 1 liter in total, and the pH of the developer and its replenisher were each adjusted to 10.06 and 10.18, respectively with potassium hydroxide and sulfuric acid.

Bleach and replenisher thereof:

| | Worker | Replenisher |
|---|---|---|
| Water | 700 ml | 700 ml |
| Ammonium iron (III) 1,3-diaminopropanetetraacetic acid | 125 g | 175 g |
| Ethylenediaminetetraacetic acid | 2 g | 2 g |
| Sodium nitrate | 40 g | 50 g |
| Ammonium bromide | 150 g | 200 g |
| Glacial acetic acid | 40 g | 56 g |

Water was added to make 1 liter in total and the pH of the bleach and replenisher thereof were adjusted to 4.4 and 4.0, respectively, with ammoniacal water or glacial acetic acid.

Fixer and replenisher thereof:

| | Worker | Replenisher |
|---|---|---|
| Water | 800 ml | 800 ml |
| Ammonium thiocyanate | 120 g | 150 g |
| Ammonium thiosulfate | 150 g | 180 g |
| Sodium sulfite | 15 g | 20 g |
| Ethylenediaminetetraacetic acid | 2 g | 2 g |

Water was added to make 1 liter in total and the pH of the fixer and replenisher thereof were adjusted to 6.2 and 6.5, respectively, with ammoniacal water or glacial acetic acid.

Stabilizer and replenisher thereof:

| | |
|---|---|
| Water | 900 ml |
| p-Octylphenol/ethyleneoxide (10 mol) adduct | 2.0 g |
| Dimethylolurea | 0.5 g |
| Hexamethylenetetramine | 0.2 g |
| 1,2-benzoisothiazoline-3-one | 0.1 g |
| Siloxane (L-77, product by UCC) | 0.1 g |
| Ammoniacal water | 0.5 ml |

Water was added to make 1 liter in total and the pH thereof was adjusted to 8.5 with ammoniacal water or sulfuric acid (50%).

Sensitivity and fog of processed samples each were measure using green light according to the following manner.

Sensitivity, which was represented in terms of reciprocal of exposure necessary for giving a density of the minimum density (Dmin) plus 0.2, was shown as a relative value, based on the sensitivity of Sample 108 being 100. The more the sensitivity, the higher and more acceptable.

A fog increase due to pressure was evaluated by measuring an increase in density at a loaded non-exposure portion and shown as a relative value (ΔDp1), based on the density increase of Sample 108 being 100. The less this value, the less the increase in density due to pressure and the more superior in pressure resistance. A sensitivity lowering due to pressure was evaluated by measuring a decrease in density at a loaded portion with a density of (Dmax-Dmin)/2 and shown as a relative value (ΔDp2), based on the density decrease of Sample 108 being 100. The less this value, the less the sensitivity lowering due to pressure and the more superior in pressure resistance.

Samples were also processed in shortened development of 2 min.50 sec. and developability of each sample was evaluated in terms of difference in sensitivity between development 3 min.15 sec and 2 min.50 sec. (ΔS) which was shown as relative value, based on that of Sample 108 being 100.

Evaluation results of each emulsion are shown in Table 1.

(11) Observation of Dislocation Lines and Silver Iodide Border/Measurement of Silver Iodide Content Variation Each emulsion was diluted to 5 tomes with ultra-pure water, centrifuged and redispersed in ultra-pure water. The dispersion was dropped onto a 200 mesh with hydrophilic carbon supporting membrane and extra water was removed with a spin coater. Electronmicrographs of about 700 grains were taken at a temperature of −130° C. and a direct magnification of 8.000 to 10,000 times using a transmission electronmicroscope at an acceleration voltage of 200 kV, the proportion of grains having 30 or more dislocation lines per grain in the fringe portion and that of grains having a silver iodide border were each determined. An electronmicrograph of a tabular grain having the silver iodide border is exemplarily shown in FIG. 1.

Using the same sample and apparatus, the silver iodide content variation from the center to the edge of the grain was measured by the EPMA method (TEM-EDS method). Measurements at 16 points on the straight line from the grain center to the edge were made at an acceleration voltage of 200 kV, a temperature of −130° C. and with a spot diameter of 20 nm over a total period of 50 sec. The proportion of grains having the variation within the range of −0.03 mol %/nm and +0.03 mol %/nm, based on the grain projected area, was determined for each emulsion. Results thereof are shown in Table 1.

as Example 1. Results are shown in Table 2. As can be seen from the results, effects of the present invention were marked in the emulsion with a narrow grain size distribution and grain thickness distribution.

Example 3

(1) Preparation of Inventive Emulsion Em-10

Emulsion Em-10 was prepared in the same manner as Em-7, except that in the grain growth stage, after completing addition of a solution (S-1), solution (R-1) described below was instantaneously added and after instantaneously adding solution (T-1) described below, the temperature was lowered

TABLE 1

| Sample | Emulsion | Tabular grains*1 | Iodide ion incorporation method | Reaction temp. | Iodide ion incorporation amount*2 | Dislocation line grain*3 | AgI gradual variation emulsion | Bounder containing grain*6 | Sensitivity | ΔDp1 | ΔDp2 | ΔS | Remark |
|---|---|---|---|---|---|---|---|---|---|---|---|---|---|
| 101 | Em-1 | 94% | KI | 40° C. | 1.3 mol % | 79% | 3%*4 (1%*5) | 32% | 181 | 111 | 198 | 188 | Comp. |
| 102 | Em-2 | 94% | KI | 55° C. | 1.3 mol % | 78% | 2% (2%) | 35% | 179 | 105 | 209 | 210 | Comp. |
| 103 | Em-3 | 95% | AgI | 40° C. | 1.3 mol % | 49% | 36% (22%) | 56% | 109 | 117 | 231 | 225 | Comp. |
| 104 | Em-4 | 94% | AgI | 55° C. | 1.3 mol % | 53% | 32% (19%) | 52% | 121 | 104 | 222 | 210 | Comp. |
| 105 | Em-5 | 95% | Iodide ion releasing agent | 40° C. | 1.3 mol % | 86% | 79% (76%) | 13% | 211 | 78 | 86 | 88 | Inv. |
| 106 | Em-6 | 93% | Iodide ion releasing agent | 55° C. | 1.3 mol % | 83% | 44% (39%) | 26% | 201 | 101 | 151 | 101 | Inv. |
| 107 | Em-7 | 94% | Iodide ion releasing agent | 40° C. | 0.9 mol % | 79% | 93% (91%) | 4% | 209 | 55 | 38 | 68 | Inv. |
| 108 | Em-8 | 92% | — | 40° C. | 0 | 0% | 96% (0%) | 0% | 100 | 100 | 100 | 100 | Comp. |

*1: Percentage of tabular grains having an aspect ratio of 5 or more, based on total grain projected area
*2: Mol %, based on silver amount of final grains
*3: Percentage of tabular grains having 30 or more dislocation lines per grain, based on total grain projected area
*4: Percentage of tabular grains in which the iodide content gradually and continuously varies, based on total grain projected area
*5: Percentage of tabular grains having 30 or more dislocation lines per grain in which the iodide content gradually and continuously varies, base on total grain projected area
*6: Percentage of tabular grains having a high iodide bounder, based on total grain projected area Example 2

(1) Preparation of Inventive Emulsion Em-9

Emulsion Em-9 was prepared in the same manner as Em-7, except that the ripening process was varied as follow.

After completing the nucleation stage, solution (G-1) was added and the temperature was raised to 60° C. in 30 min., while the silver potential of the emulsion contained in a reaction vessel was controlled at 6 mV (measured with a silver ion selection electrode with a reference electrode of a saturated silver-silver chloride electrode) using a 2N potassium bromide solution. Thereafter, stirring was continued further 15 min. and then the pH was adjusted to 6.1 with potassium hydroxide while the silver potential was maintained at 6 mV using a 2N potassium bromide solution.

As a result of electronmicroscopic observation, it was proved that the resulting emulsion was comprised of tabular grains having an average diameter of 1.53 μm (average equivalent circle diameter), an aspect ratio of 7.3 at 50% of the total grain projected area (i.e., 50% of the total grain projected area being accounted for tabular grains having an aspect ratio of 7.3 or more), a variation coefficient of grain diameter distribution of 28.0.0% and a variation coefficient of thickness of 37.4%. The proportion of the grains having dislocation lines, that of grains having a slow, continuous silver iodide content variation and that of grains having a silver iodide border, based on the grain projected area, are 76%, 91% and 9%, respectively.

(2) Evaluation of Emulsion

Using the emulsion, Em-9, a photographic material sample 109 was prepared and evaluated in the same manner to 40° C. From electronmicrograph of the grains, it was proved that the resulting emulsion grains were substantially the same as Em-1.

| | |
|---|---|
| (R-1) | |
| Thiourea dioxide | 26.6 mg |
| Distilled water | 46.6 ml |
| (T-1) | |
| Sodium ethanethiosulfonate | 880.1 ml |
| Distilled water | 293.4 ml |

(2) Preparation of Inventive emulsion Em-11

Emulsion Em-11 was prepared in the same manner as Em-10, except that, after completing grain growth and desalting, gelatin was added, the temperature was adjusted to 50° C., then solution (F-2) was added thereto, and ripening was conducted for 20 min.; thereafter, the temperature was lowered to 40° C. and the pH and pAg were adjusted to 5.80 and 8.06, respectively.

| (F-2) | |
|---|---|
| Fine silver bromide grain emulsion (av. size of 0.05 μm) doped with $K_2IrCl_6$ | 4.70 g |

The above emulsion was prepared in the following manner. To 5000 ml of a 6.0 wt. % gelatin solution containing 0.06 mol of potassium bromide, an aqueous solution containing 7.06 mol of silver nitrate and an aqueous solution containing 7.06 mol of potassium bromide, 2000 ml of each were added over a period of 10 min., while the pH was maintained at 2.0 using nitric acid and the temperature was maintained at 40° C. After completion of grain formation, the pH was adjusted to 6.0 using a sodium carbonate aqueous solution. The finished weight of the emulsion was 12.53 kg.

(3) Preparation of Comparative Emulsion Em-12

Emulsion 12 was prepared in the same manner as Em-1, except that similarly to Em-10, after completing addition of a solution (S-1), solution (R-1) described below was instantaneously added and after instantaneously adding solution (T-1) described below, the temperature was lowered to 40° C. From electronmicrograph of the grains, it was proved that the resulting emulsion grains were substantially the same as Em-1.

(4) Preparation of Comparative Emulsion Em-13

Emulsion Em-13 was prepared in the same manner as Em-12, except that, similarly to Em-12, after completing grain growth and desalting, gelatin was added, the temperature was adjusted to 50° C., then solution (F-2) was added thereto, and ripening was conducted for 20 min.; thereafter, the temperature was lowered to 40° C. and the pH and pAg were adjusted to 5.80 and 8.06, respectively.

Emulsions Em-10 to Em-13 were each the same in the average grain diameter, aspect ratio, variation coefficient of grain diameter and variation coefficient of grain thickness as those of Em-1.

(5) Evaluation of Emulsion

Using the emulsion, Em-10 to 13, photographic material samples 110 to 113 were prepared and evaluated in the same manner as Example 1. Results are shown in Table 2. As can be seen from the results, the inventive emulsion exhibited synergistic effects with reduction sensitization and metal-doping.

TABLE 2

| Sample | Emulsion | Remarks | Sensitivity | ΔDp1 | ΔDp2 | ΔS |
|---|---|---|---|---|---|---|
| 101 | Em-1 | Comp. (*1) | 181 | 111 | 198 | 188 |
| 107 | Em-7 | Inv. (*2) | 209 | 55 | 38 | 68 |
| 108 | Em-8 | Comp. (*3) | 100 | 100 | 100 | 100 |
| 109 | Em-9 | Inv. (*4) | 181 | 86 | 87 | 90 |
| 110 | Em-10 | Inv. (*5) | 247 | 39 | 28 | 70 |
| 111 | Em-11 | Inv. (*6) | 296 | 38 | 30 | 66 |
| 112 | Em-12 | Comp. (*7) | 186 | 113 | 197 | 189 |
| 113 | Em-13 | Comp. (*8) | 185 | 109 | 195 | 190 |

*1: Dislocation lines introduced with KI
*2: Narrow distributions of grain size and thickness
*3: No dislocation line
*4: Broad distribution of grain size and thickness
*5: Reduction-sensitized Em-7
*6: Reduction-sensitized and metal-doped Em-7
*7: Reduction-sensitized Em-1
*8: Reduction-sensitized and metal-doped Em-1

Example 4

On a triacetyl cellulose film support were formed the following layers containing composition as shown below. A multi-layered color photographic material Sample 407 was prepared, in which chemically and spectrally sensitized emulsion Em-7 was used in the high-speed green sensitive layer. The addition amount of each compound was represented in term of g/m$^2$, provided that the amount of silver halide or colloidal silver was converted to the silver amount and the amount of a sensitizing dye was represented in mol/Ag mol.

| | |
|---|---|
| 1st Layer: Anti-Halation Layer | |
| Black colloidal silver | 0.16 |
| UV absorbent (UV - 1) | 0.3 |
| Colored magenta coupler (CM-1) | 0.123 |
| Colored cyan coupler (CC-1) | 0.044 |
| High boiling solvent (OIL - 1) | 0.167 |
| Gelatin | 1.33 |
| 2nd Layer: Intermediate Layer | |
| Anti-staining agent (AS-1) | 0.160 |
| High boiling solvent (OIL - 1) | 0.20 |
| Gelatin | 0.69 |
| 3rd Layer: Low-speed Red-Sensitive Layer | |
| Silver iodobromide emulsion a | 0.20 |
| Silver iodobromide emulsion b | 0.29 |
| SD - 1 | $2.37 \times 10^{-5}$ |
| SD - 2 | $1.2 \times 10^{-4}$ |
| SD - 3 | $2.4 \times 10^{-4}$ |
| SD - 4 | $2.4 \times 10^{-6}$ |
| C - 1 | 0.32 |
| CC-1 | 0.038 |
| (OIL-2 | 0.28 |
| AS-2 | 0.002 |
| Gelatin | 0.73 |
| 4th Layer: Medium-speed Red-sensitive Layer | |
| Silver iodobromide emulsion c | 0.10 |
| Silver iodobromide emulsion d | 0.86 |
| SD-1 | $4.5 \times 10^{-5}$ |
| SD-2 | $2.3 \times 10^{-4}$ |
| SD-3 | $4.5 \times 10^{-4}$ |
| C-2 | 0.52 |
| CC-1 | 0.06 |
| DI-1 | 0.047 |
| OIL-2 | 0.46 |
| AS-2 | 0.004 |
| Gelatin | 1.30 |
| 5th Layer: High-speed Red-Sensitive Layer | |
| Silver iodobromide emulsion c | 0.13 |
| Silver iodobromide emuision d | 1.18 |
| SD - 1 | $3.0 \times 10^{-5}$ |
| SD - 2 | $1.5 \times 10^{-4}$ |
| SD - 3 | $3.0 \times 10^{-4}$ |
| C-2 | 0.047 |
| C-3 | 0.09 |
| CC - 1 | 0.036 |
| DI-1 | 0.024 |
| OIL-2 | 0.27 |
| AS-2 | 0.006 |
| Gelatin | 1.28 |
| 6th Layer: Intermediate Layer | |
| OIL-1 | 0.29 |
| AS-1 | 0.23 |
| Gelatin | 1.00 |
| 7th Layer: Low-speed Green-Sensitive Layer | |
| Silver iodobromide emulsion a | 0.19 |
| Silver iodobromide emulsion b | 0.062 |
| SD-4 | $3.6 \times 10^{-4}$ |
| SD-5 | $3.6 \times 10^{-4}$ |
| M - 1 | 0.18 |
| CM - 1 | 0.033 |
| IL-1 | 0.22 |
| AS-2 | 0.002 |
| AS-3 | 0.05 |

-continued

| | |
|---|---|
| Gelatin | 0.61 |
| 8th layer: Interlayer | |
| OIL-1 | 0.26 |
| AS-1 | 0.054 |
| Gelatin | 0.80 |
| 9th Layer: Medium-speed Green-Sensitive Layer | |
| Silver iodobromide emulsion e | 0.54 |
| Silver iodobromide emulsion f | 0.54 |
| SD-6 | $3.7 \times 10^{-4}$ |
| SD-7 | $7.4 \times 10^{-5}$ |
| SD-8 | $5.0 \times 10^{-5}$ |
| M - 1 | 0.17 |
| M-2 | 0.33 |
| CM - 1 | 0.024 |
| CM-2 | 0.029 |
| DI-2 | 0.024 |
| DI-3 | 0.005 |
| OIL-1 | 0.73 |
| AS-2 | 0.003 |
| AS-3 | 0.035 |
| Gelatin | 1.80 |
| 10th Layer: High-speed Green-Sensitive Layer | |
| Em-7 | 1.19 |
| M - 1 | 0.065 |
| CM-1 | 0.022 |
| CM-2 | 0.026 |
| DI-2 | 0.003 |
| DI-3 | 0.003 |
| OIL-1 | 0.19 |
| OIL-2 | 0.43 |
| AS-2 | 0.014 |
| AS-3 | 0.017 |
| Gelatin | 1.23 |
| 11th Layer: Yellow Filter Layer | |
| Yellow colloidal silver | 0.05 |
| OIL-1 | 0.18 |
| AS-1 | 0.16 |
| Gelatin | 1.00 |
| 12th Layer: Low-speed Blue-sensitive Layer | |
| Silver iodobromide emulsion a | 0.08 |
| Silver iodobromide emulsion b | 0.22 |
| Silver iodobromide emuision g | 0.09 |
| SD-9 | $6.5 \times 10^{-4}$ |
| SD-10 | $2.5 \times 10^{-4}$ |
| Y-1 | 0.77 |
| DI-4 | 0.017 |
| OIL-1 | 0.31 |
| AS-2 | 0.002 |
| Gelatin | 1.29 |
| 13th Layer: High-sped Blue-sensitive Layer | |
| Silver iodobromide emulsion g | 0.41 |
| Silver iodobromide emulsion h | 0.61 |
| SD-9 | $4.4 \times 10^{-4}$ |
| SD-10 | $1.5 \times 10^{-4}$ |
| Y-1 | 0.23 |
| OIL-1 | 0.10 |
| AS-2 | 0.004 |
| Gelatin | 1.20 |
| 14th Layer: First Protective Layer | |
| Silver iodobromide emulsion i | 0.30 |
| UV-1 | 0.055 |
| UV-2 | 0.110 |
| OIL-2 | 0.30 |
| Gelatin | 1.32 |
| 15th Layer: Second protective Layer | |
| PM-1 | 0.15 |
| PM-2 | 0.04 |
| WAX-1 | 0.02 |
| D-1 | 0.001 |
| Gelatin | 0.55 |

Characteristics of silver iodobromide emulsions described above are shown below, in which the average grain size refers to an edge length of a cube having the same volume as that of the grain.

| Emulsion | Av. grain size (μm) | Av. AgI content (mol %) | Diameter/thickness ratio |
|---|---|---|---|
| a | 0.30 | 2.0 | 1.0 |
| b | 0.40 | 8.0 | 1.4 |
| c | 0.60 | 7.0 | 3.1 |
| d | 0.74 | 7.0 | 5.0 |
| e | 0.60 | 7.0 | 4.1 |
| f | 0.65 | 8.7 | 6.5 |
| h | 0.65 | 8.0 | 1.4 |
| i | 1.00 | 8.0 | 2.0 |
| j | 0.05 | 2.0 | 1.0 |

Of the emulsions described above, for example, emulsions d and f were prepared according to the following procedure described below. Emulsions a, b, c, e, g, h and i were prepared in a manner similar to emulsions d and f. A Seed Emulsion-1 was prepared in the following manner.

Preparation of Seed Emulsion-1

To Solution A1 maintained at 35° C. and stirred with a mixing stirrer described in JP-B 58-58288 and 58-58289 were added an aqueous silver nitrate solution (1.161 mol) and an aqueous potassium bromide and potassium iodide mixture solution (containing 2 mol % potassium iodide) by the double jet method in 2 min., while keeping the silver potential at 0 mV (measured with a silver electrode and a saturated silver-silver chloride electrode as a reference electrode), to form nucleus grains. Then the temperature was raised to 60° C. in 60 min. and after the pH was adjusted to 5.0 with an aqueous sodium carbonate solution, an aqueous silver nitrate solution (5.902 mol) and an aqueous potassium bromide and potassium iodide mixture solution (containing 2 mol % potassium iodide) were added by the double jet method in 42 minutes, while keeping the silver potential at 9 mV. After completing the addition, the temperature was lowered to 40° C. and the emulsion was desalted according to the conventional flocculation washing. The obtained seed emulsion was comprised of grains having an average equivalent sphere diameter of 0.24 μm and an average aspect ratio of 4.8. At least 90% of the total grain projected area was accounted for by hexagonal tabular grains having the maximum edge ratio of 1.0 to 2.0. This emulsion was denoted as Seed Emulsion-1

| Solution A | |
|---|---|
| Ossein gelatin | 24.2 g |
| Potassium bromide | 10.8 g |
| $HO(CH_2CH_2O)m(CH(CH_3)CH_2O)_{19.8}(CH_2CH_2O)nH$ (m + n = 9.77) 10 wt. % methanol solution | 6.78 ml |
| Nitric acid (1.2N) | 114 ml |
| Distilled water to make | 9657 ml |

Preparation of Fine Silver Iodide Grain Emulsion SMC-1

To 5 liters of a 6.0 wt. % gelatin solution containing 0.06 mol of potassium iodide, an aqueous solution containing 7.06 mol of silver nitrate and an aqueous solution containing 7.06 mol of potassium iodide, 2 liters of each were added over a period of 10 min., while the pH was maintained at 2.0 using nitric acid and the temperature was maintained at 40° C. After completion of grain formation, the pH was adjusted to 6.0 using a sodium carbonate aqueous solution. The resulting emulsion was comprised of fine silver iodide grains having an average diameter of 0.05 μm, and was denoted as SMC-1.

Preparation of Silver Iodobromide Emulsion d 700 ml of an aqueous 4.5 wt. % inert gelatin solution containing 0.178 mol equivalent of Seed Emulsion-1 and 0.5 ml of a 10% surfactant ethanol solution $\{(CH_2CH_2O)m[CH(CH_3)CH_2O]1_{9.8}\ (CH_2CH_2O)nH,\ m+n=9.77\}$ was maintained at 75° C. and after adjusting the pAg and pH to 8.3 and 5.0, respectively, a silver halide emulsion was prepared while vigorously stirring, according to the following procedure.

1) An aqueous silver nitrate solution of 3.093 mol, SMC-1 of 0.287 mol and an aqueous potassium bromide solution were added by the double jet method while keeping the pAg and pH were maintained at 8.4 and 5.0, respectively.

2) Subsequently, the temperature was lowered to 60° C. and the pAg was adjusted to 9.8. Then, SMC-1 of 0.071 mol was added and ripened for 2 min (introduction of dislocation lines).

3) Further, an aqueous silver nitrate solution of 0.959 mol, SMC-1 of 0.030 mol and an aqueous potassium bromide solution were added by the double jet method while keeping the pAg and pH were maintained at 9.8 and 5.0, respectively.

During the grain formation, each of the solutions was added at an optimal flow rate so as not to cause nucleation or Ostwald ripening. After completing the addition, the emulsion desalted at 40° C. by the conventional flocculation method, gelatin was added thereto and the emulsion was redispersed and adjusted to a pAg of 8.1 and a pH of 5.8. The resulting emulsion was comprised of tabular grains having an average size (an edge length of a cube with an equivalent volume) of 0.74 μm, average aspect ratio of 5.0 and exhibiting the iodide content from the grain interior of 2/8.5/X/3 mol %, in which X represents the dislocation line-introducing position. From electron microscopic observation, it was proved that at least 60% of the total grain projected area was-accounted for by grains having 5 or more dislocation lines both in fringe portions and in the interior of the grain. The silver iodide content of the surface was 6.7 mol %.

Preparation of Silver Iodobromide Emulsion f

Silver iodobromide emulsion f was prepared in the same manner as emulsion d, except that in the step 1), the pAg, the amount of silver nitrate to be added and the SMC-1 amount were varied to 8.8, 2.077 mol and 0.218 mol, respectively; and in the step 3), the amounts of silver nitrate and SMC-1 were varied to 0.91 mol and 0.079 mol, respectively. The resulting emulsion was comprised of tabular grains having an average size (an edge length of a cube with an equivalent volume) of 0.65 μm, average aspect ratio of 6.5 and exhibiting the iodide content from the grain interior of 2/9.5/X/8 mol %, in which X represents the dislocation line-introducing position. From electron microscopic observation, it was proved that at least 60% of the total grain projected area was accounted for by grains having 5 or more dislocation lines both in fringe portions and in the interior of the grain. The silver iodide content of the surface was 11.9 mol %.

The thus prepared emulsions d and f were added with sensitizing dyes afore-described and ripened, and then chemically sensitized by adding triphenylphosphine selenide, sodium thiosulfate, chloroauric acid and potassium thiocyanate until relationship between sensitivity and fog reached an optimum point. Silver iodobromide emulsions a, b, c, g, h, and i were each spectrally and chemically sensitized in a manner similar to silver iodobromide emulsions d and f.

In addition to the above composition were added coating aids SU-1, SU-2 and SU-3; a dispersing aid SU-4; viscosity-adjusting agent V-1; stabilizers ST-1 and ST-2; fog restrainer AF-1 and AF-2 comprising two kinds polyvinyl pyrrolidone of weight-averaged molecular weights of 10,000 and 1.100,000; inhibitors AF-3, AF-4 and AF-5; hardener H-1 and H-2; and antiseptic Ase-1.

Chemical formulas of compounds used in the Samples described above are shown below.

C-1

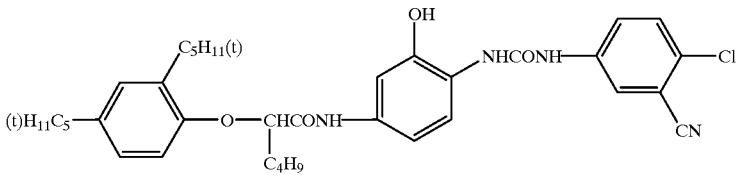

C-2

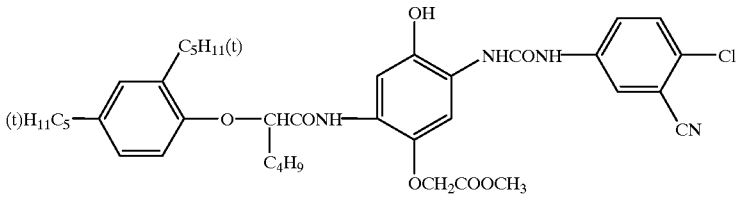

-continued
C-3
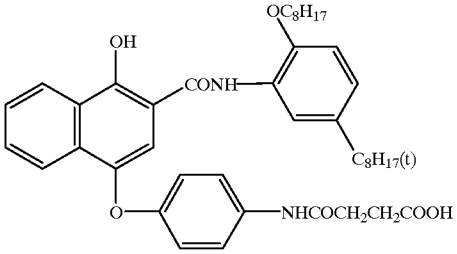
M-1
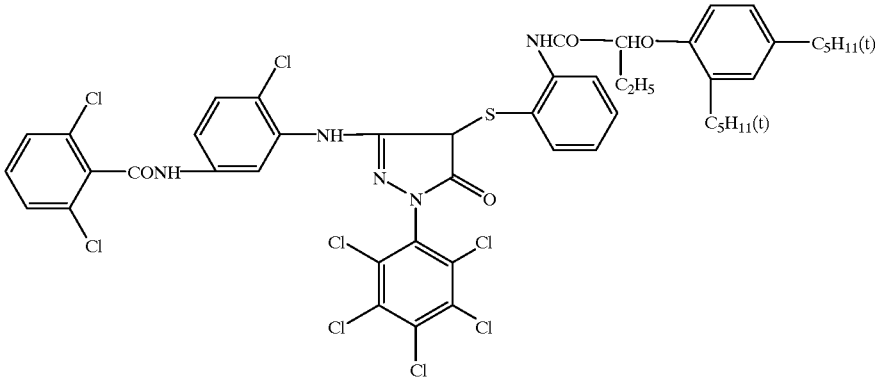
M-2
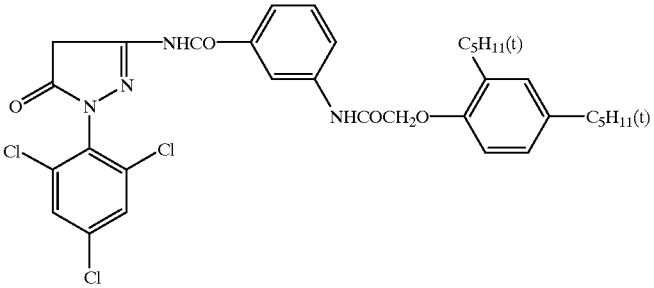
Y-1
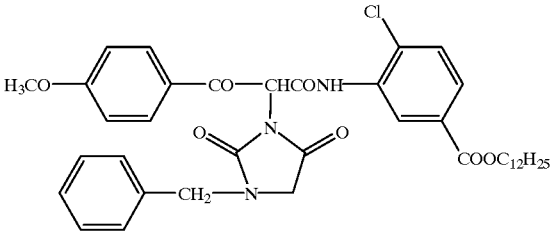

-continued
CC-1
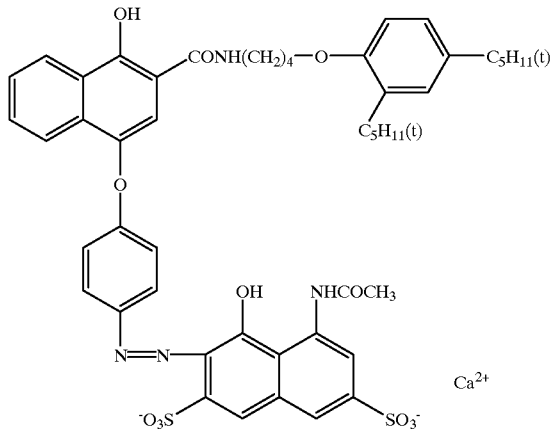
CM-1
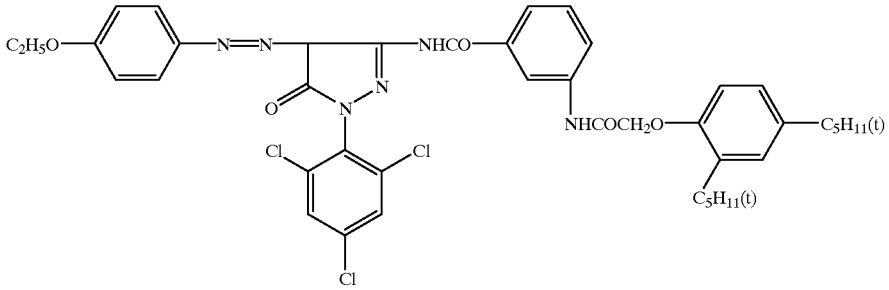
CM-2
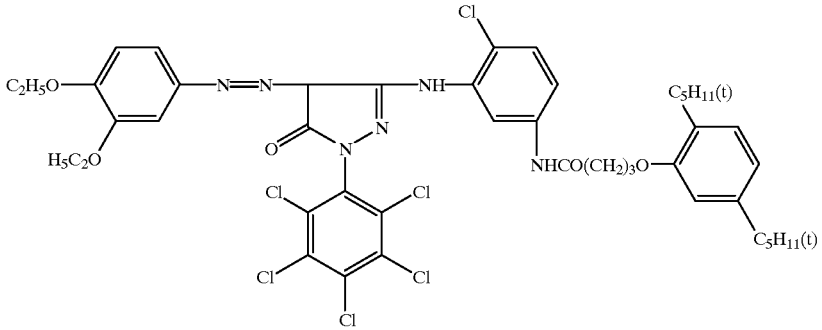
DI-1
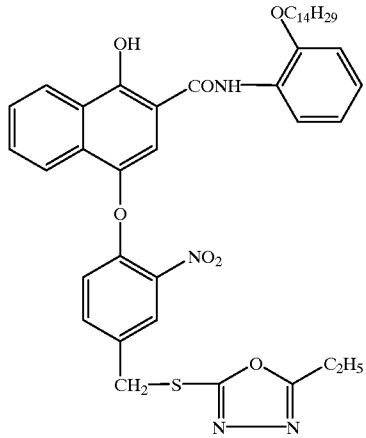

-continued
DI-2
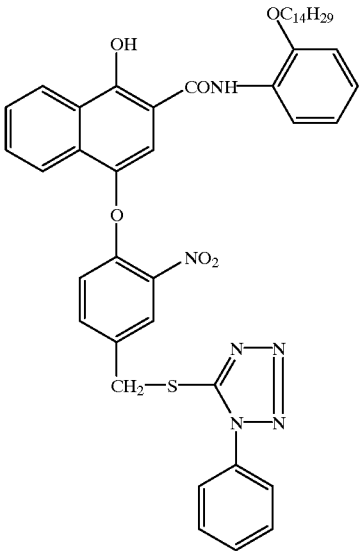
DI-3
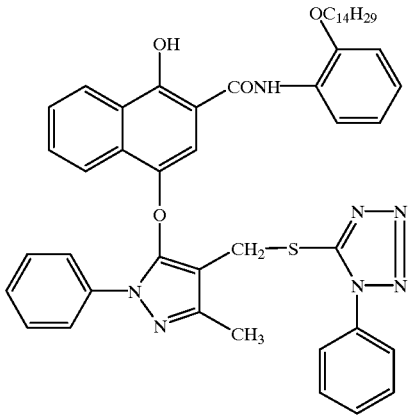
DI-4
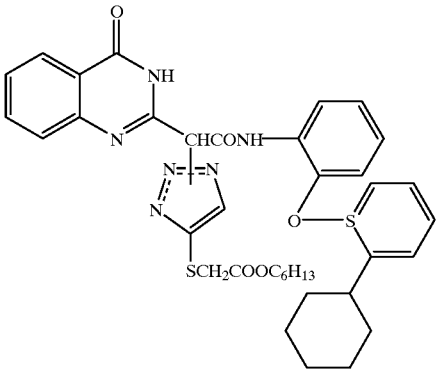
AS-1
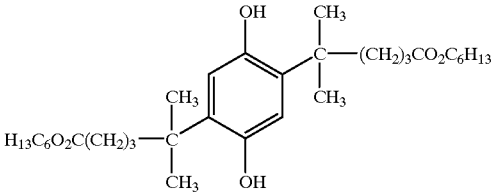
AS-2
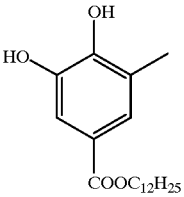
AS-3
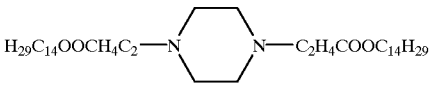
SD-1
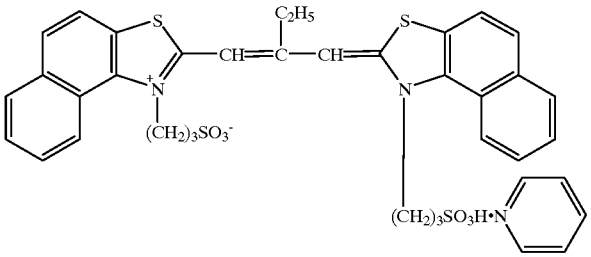
SD-2
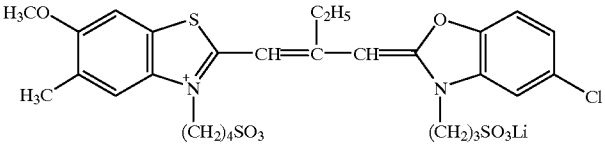

-continued
SD-3
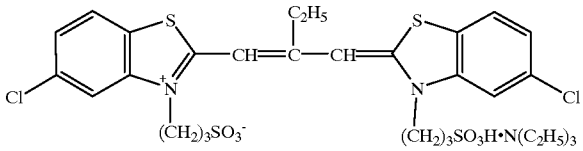
SD-4
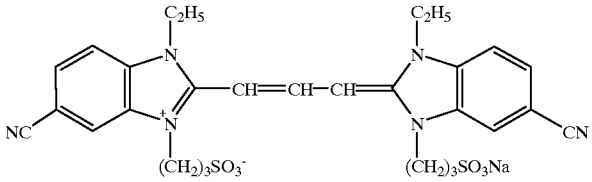
SD-5
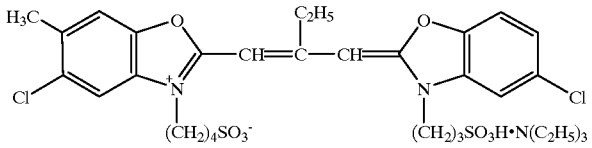
SD-6
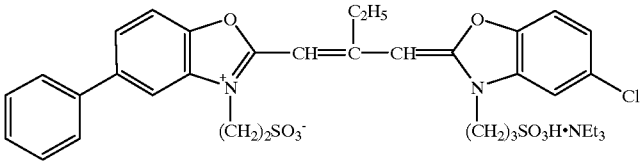
SD-7
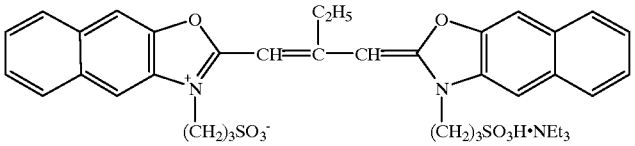
SD-8
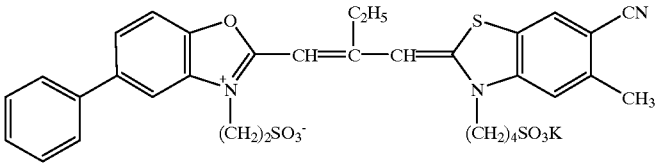
SD-9
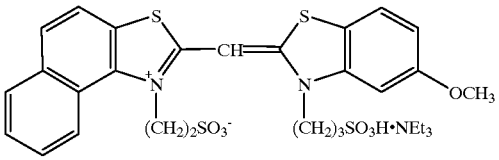
SD-10
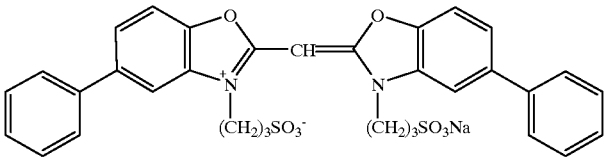
ST-1
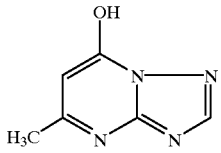
ST-2
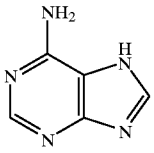

-continued
AF-1,2
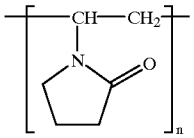
AF-1 Mw = 10,000
AF-2 Mw = 1,100,000
n: Polymerization degree
AF-3
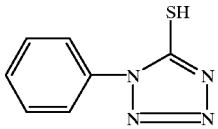
AF-4
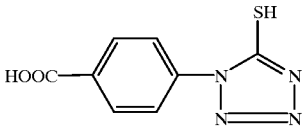
AF-5
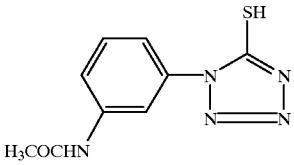
SU-1
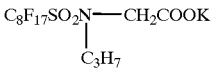
SU-2
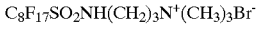
SU-3
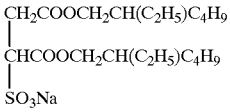
SU-4
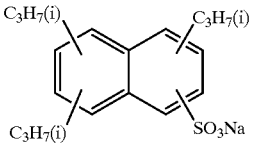
WAX-1
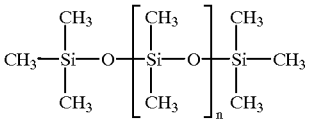
Mw = 3,000
D-1
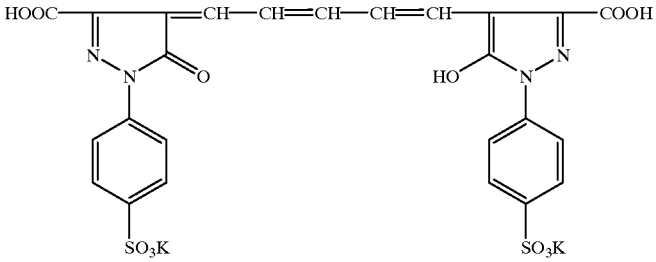
PM-1
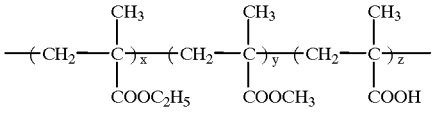
x:y:z = 3:3:4
PM-2
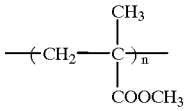
n: Polymerization degree
OIL-1
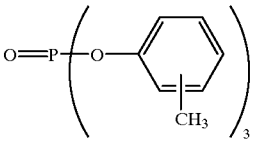
UV-1
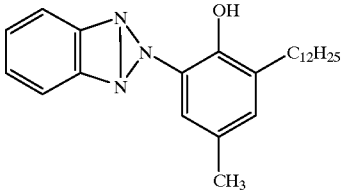

-continued

OIL-2

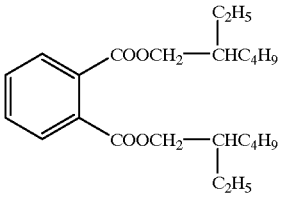

UV-2

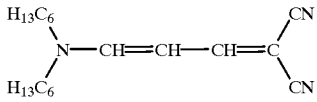

V-1

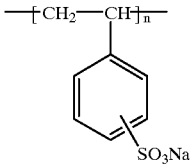

n: Polymerization degree

Ase-1(Mixture)

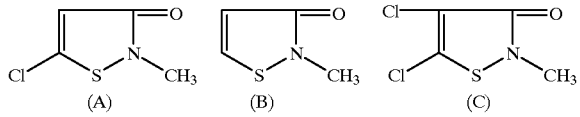

A:B:C = 50:40:4 (molar ratio)

H-1

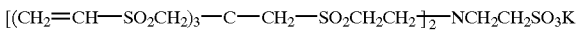

H-2

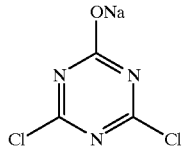

The photographic material sample 407 was thus prepared. Samples 401, 411 and 413 were each prepared in the same manner as Sample 407, except that emulsion Em-7 was respectively replaced by Em-1, Em-11 or Em-13. These samples were evaluated in the same manner as in Example 1 and there were obtained similar results to a single emulsion layer samples as shown in Tables 1 and 2. Results thereof are shown in Table 3.

TABLE 3

| Sample | Emulsion | Remarks | Sensitivity | ΔDp1 | ΔDp2 | ΔS |
|---|---|---|---|---|---|---|
| 401 | Em-1 | Comp. (*1) | 179 | 115 | 188 | 191 |
| 407 | Em-7 | Inv. (*2) | 211 | 55 | 38 | 67 |
| 411 | Em-11 | Inv. (*3) | 301 | 36 | 30 | 57 |
| 413 | Em-13 | Inv. (*4) | 184 | 112 | 199 | 189 |

*1: Dislocation lines introduced with KI
*2: Narrow distributions of grain size and thickness
*3: Reduction-sensitized and metal-doped Em-7
*4: Reduction-sensitized and metal-doped Em-1

What is claimed is:

1. A silver halide emulsion comprising silver halide grains, wherein at least 30% of total grain projected area is accounted for by tabular grains having an aspect ratio of 5 or more; said tabular grains further having dislocation lines of 30 or more per a grain, in a fringe portion of the grain, and said tabular grains each containing silver iodide, the content of which gradually and continuously varies from a center to an edge of the grains.

2. The silver halide emulsion of claim 1, wherein a silver iodide content variation in the direction of from the center to the edge of the grain is within a range of −0.03 mol %/nm and +0.03 mol %/nm.

3. The silver halide emulsion of claim 1, wherein tabular grains having a silver iodide border account for less than 20% of total grain projected area.

4. The silver halide emulsion of claim 1, wherein a variation coefficient of grain size distribution is 25% or less, a variation coefficient of grain thickness distribution being 35% or less.

5. The silver halide emulsion of claim 1, wherein at least 50% of the projected area of total silver halide grains is accounted for by tabular grains having 30 or more dislocation lines per a grain, only in the fringe portion of the grains.

6. The silver halide emulsion of claim 1, wherein at least a part of the tabular grains each contain a reduction sensitization center in the interior of the grains.

7. The silver halide emulsion of claim 1, wherein at least a part of the tabular grains each contain a polyvalent metal compound in the fringe portion of the grains.

8. A silver halide emulsion comprising silver halide grains, wherein at least 50% of total grain projected area is accounted for by tabular grains having an aspect ratio of 5 or more; at least 50% of total grain projected area is accounted for by tabular grains having dislocation lines of 30 or more per a grain, in a fringe portion of the grains; and at least 50% of total grain projected area is accounted for by tabular grains containing silver iodide, the content of which gradually and continuously varies from a center to an edge of the grains.

* * * * *